US008907993B2

(12) United States Patent
Komatsu et al.

(10) Patent No.: US 8,907,993 B2
(45) Date of Patent: Dec. 9, 2014

(54) DISPLAY DEVICE INCLUDING A DATA SELECTOR CIRCUIT

(75) Inventors: Hiroaki Komatsu, Mobara (JP); Masahiro Maki, Mobara (JP); Hiroyuki Abe, Chiba (JP)

(73) Assignee: Japan Display Inc., Tokyo (JP)

( * ) Notice: Subject to any disclaimer, the term of this patent is extended or adjusted under 35 U.S.C. 154(b) by 268 days.

(21) Appl. No.: 13/424,540

(22) Filed: Mar. 20, 2012

(65) Prior Publication Data

US 2012/0249616 A1 Oct. 4, 2012

(30) Foreign Application Priority Data

Mar. 30, 2011 (JP) ..... 2011-075065

(51) Int. Cl.
*G09G 5/10* (2006.01)
*G09G 3/36* (2006.01)

(52) U.S. Cl.
CPC ..... *G09G 3/3688* (2013.01); *G09G 2320/0233* (2013.01); *G09G 2310/0248* (2013.01); *G09G 2310/0297* (2013.01); *G09G 2310/08* (2013.01)
USPC ..... 345/690; 345/96; 345/98; 345/100

(58) Field of Classification Search
CPC . G09G 3/3685; G09G 3/3688; G09G 3/3614; G09G 3/3655; G09G 2310/0248; G09G 2310/0251; G09G 2310/0254; G09G 2310/027; G09G 2310/0289; G09G 2310/0294; G09G 2310/0297
USPC ..... 345/54, 96, 98, 100, 209, 690
See application file for complete search history.

(56) References Cited

U.S. PATENT DOCUMENTS

| | | | | |
|---|---|---|---|---|
| 6,266,039 | B1 * | 7/2001 | Aoki | 345/94 |
| 2001/0015711 | A1 * | 8/2001 | Aoki | 345/92 |
| 2003/0122769 | A1 * | 7/2003 | Ota | 345/96 |
| 2004/0179014 | A1 * | 9/2004 | Nakano et al. | 345/501 |
| 2005/0078078 | A1 * | 4/2005 | Morita | 345/100 |
| 2006/0232539 | A1 * | 10/2006 | Hashimoto | 345/96 |
| 2010/0109010 | A1 | 5/2010 | Miyake et al. | |
| 2011/0205194 | A1 * | 8/2011 | Takahashi et al. | 345/204 |

FOREIGN PATENT DOCUMENTS

| | | |
|---|---|---|
| JP | 2003-108093 | 4/2003 |
| JP | 2005-37832 | 2/2005 |
| JP | 2010-109286 | 5/2010 |

* cited by examiner

*Primary Examiner* — Koosha Sharifi-Tafreshi
(74) *Attorney, Agent, or Firm* — Antonelli, Terry, Stout & Kraus, LLP.

(57) ABSTRACT

A display device includes a plurality of gate lines, a plurality of data lines, a gate circuit, a driver, and a data selector circuit that includes a plurality of switch groups each of which has a time division switch and a timing adjustment switch that are connected in parallel. The data selector circuit outputs output signals from the driver, which have different polarities every one or more data lines of the plurality of data lines, to the respective data lines. Each of the time division switches and the timing adjustment switches is an NMOS transistor. The driver turns on the timing adjustment switches connected to the data lines to which positive output signals are output from the driver, earlier than the time division switches connected to the data lines to which negative output signals are output from the driver, by a predetermined period.

7 Claims, 15 Drawing Sheets

DISPLAY DEVICE INCLUDING A DATA SELECTOR CIRCUIT

CROSS-REFERENCE TO RELATED APPLICATION

The present application claims priority from Japanese Application JP2011-075065, filed on Mar. 30, 2011, the content to which is hereby incorporated by reference into this application.

BACKGROUND OF THE INVENTION

1. Field of the Invention

The present invention relates to a display device, and particularly to a display device having a data selector circuit including an NMOS transistor.

2. Description of the Related Art

In the related art, in the liquid crystal display, there is known a driving method of reversing polarities of written voltages with respect to a reference voltage for any given plural lines. For example, in a case of performing dot inversion every two lines, polarities of written voltages are reversed with respect to the reference voltage for a certain data line every two horizontal periods. Also, there is known a so-called data selector circuit for inputting data signals, which correspond to grayscale values and are output from a data circuit, to the respective pixels in a time division manner via RGB switches. In a display device having the data selector circuit, for example, each of the data signals, which correspond to a grayscale value and are output from the data circuit, is written in each of the pixels via time division switches that are included in the data selector circuit. Further, as the time division switch, for example, an NMOS transistor is used (refer to JP2010-109286A).

SUMMARY OF THE INVENTION

Even if gate signals are input to the NMOS transistors included in the data selector circuit at the same timing, rising speeds of output signals that are output from the output sides of the NMOS transistors are different depending on polarities of input signals that are input to the input sides of the NMOS transistors. Therefore, for example, when performing driving by reversing polarities of written voltages with respect to the reference voltage for plural lines, a potential of the common electrode may be varied, and noise may be generated in the display panel, because speeds of rising of the output signals are different.

Specifically, for example, this will be described with reference to FIGS. 15 and 16. FIG. 15 is a diagram illustrating an example of the data selector circuit for explaining a problem of one or more embodiments of the present invention, and FIG. 16 is a diagram illustrating driving timings of the data selector circuit shown in FIG. 15.

In addition, for simplification of explanation, FIGS. 15 and 16 show three input terminals of the data selector circuit, six data lines, and time division switches including six NMOS transistors. The data lines D1 to D6 are respectively connected to pixel circuits (not shown). In the following, for simplification of explanation, a data signal input to each of the data lines D1 to D6 has a predetermined voltage level (for example, corresponding to white display or black display), and operations of the switches SW1 to SW4 of plural data lines and plural time division switches will be mainly described.

As shown in FIG. 15, the data selector circuit includes plural input terminals 5*a* to 5*c* to which signals are input from a driver (not shown), and time division switches SW1 to SW6 constituted by plural NMOS transistors.

Each of the input terminals 5*a* to 5*c* is connected to two input sides of the time division switches SW1 to SW6, and output sides thereof are respectively connected to the data lines D1 to D6 connected to pixel circuits. In addition, a time division switch control line 7*a* is connected to gates of the odd numbered switches SW1 and SW3 and the like, and a time division switch control line 7*b* is connected to gates of the even numbered switches SW2 and SW4 and the like.

Next, an operation of the data selector circuit will be described. First, at a timing 1 (t1), time division switch control signals ASW1 and ASW2 become a high level state (turning-on voltage). In addition, at this time, the input terminal 5*a* is precharged with a negative voltage and the input terminal 5*b* is precharged with a positive voltage by an output signal from the driver, and thus a negative precharge voltage is applied to the data lines D1 and D2, and a positive precharge voltage is applied to the data lines D3 and D4. As described above, the time division switches SW1 to SW6 are constituted by an NMOS transistor, and thus rising speeds at the output sides are different depending on polarities applied to the input sides. Therefore, a potential of the common electrode provided in the display panel may be varied and noise may be generated in the display panel. After the precharge, the data lines D1 to D4 are precharged with the GND voltage.

At a timing 2 (t2), the time division switch control signal ASW1 becomes a high level state. In addition, a positive written voltage is applied to the input terminal 5*a*, and a negative written voltage is applied to the input terminal 5*b*. Thus, the positive written voltage is input to the data line D1, and the negative written voltage is input to the data line D3. Here, in the same manner, rising of the display voltage output to the data line D1 is later than rising of the display voltage input to the data line D3, due to the characteristics of the NMOS transistor. Thus, a potential of the common electrode may be varied and noise may be generated in the display panel.

At a timing 3 (t3), the time division switch control signal ASW2 becomes a high level state. A positive written voltage from the GND voltage is applied to the input terminal 5*a*, and a negative written voltage from the GND voltage is applied to the input terminal 5*b*. Thus, the positive written voltage is input to the data line D2, and the negative written voltage is input to the data line D4. Here, in the same manner, rising of the display voltage output to the data line D2 becomes later than rising of the display voltage output to the data line D4, due to the characteristics of the NMOS transistor. Thus, there are cases where a potential of the common electrode is varied and noise occurs in the display panel.

At a timing 4 (t4), the time division switch control signal ASW1 enters a high level state. A positive written voltage is applied to the input terminal 5*a*, and a negative written voltage is applied to the input terminal 5*b*. Thus, the positive written voltage is input to the data line D1, and the negative written voltage is input to the data line D3. Here, in the same manner, rising of the display voltage output to the data line D1 becomes later than rising of the display voltage input to the data line D3, due to the characteristics of the NMOS transistor. Thus, there are cases where a potential of the common electrode is varied and noise occurs in the display panel.

At a timing 5 (t5), the time division switch control signal ASW2 becomes a high level state. A positive written voltage is applied to the input terminal 5*a*, and a negative written voltage is applied to the input terminal 5*b*. Thus, the positive written voltage is input to the data line D2, and the negative written voltage is input to the data line D4. Here, in the same manner, rising of the display voltage output to the data line D2 is later than rising of the display voltage input to the data line D4, due to the characteristics of the NMOS transistor. Thus, there are cases where a potential of the common electrode is varied and noise occurs in the display panel.

At a timing 6 (t6), the time division switch control signals ASW1 and ASW2 become a high level state. Here, since the dot inversion every two lines is assumed, at this time, the input terminal 5*a* is precharged with a positive voltage, and the input terminal 5*b* is precharged with a negative voltage. Therefore, the positive precharge voltage is applied to the data lines D1 and D2, and the negative precharge voltage is applied to the data lines D3 and D4. As described above, since rising speeds at the output sides are different depending on polarities applied to the input sides in the NMOS transistor, a potential of the common electrode provided in the display panel may be varied and noise may be generated in the display panel. In addition, after the precharge, voltages of the input terminals 5*a* and 5*b* are changed to the GND voltage.

At a timing 7 (t7), the time division switch control signal ASW1 becomes a high level state. A negative written voltage is applied to the input terminal 5*a*, and a positive written voltage is applied to the input terminal 5*b*. Thus, the negative written voltage is input to the data line D1, and the positive written voltage is input to the data line D3. Here, in the same manner, rising of the display voltage output to the data line D3 is later than rising of the display voltage input to the data line D1, due to the characteristics of the NMOS transistor. Thus, a potential of the common electrode may be varied and noise may be generated in the display panel.

At a timing 8 (t8), the time division switch control signal ASW2 becomes a high level state. A negative written voltage from the GND voltage is applied to the input terminal 5*a*, and a positive written voltage from the GND voltage is applied to the input terminal 5*b*. Thus, the positive written voltage is input to the data line D4, and the negative written voltage is input to the data line D2. Here, in the same manner, rising of the display voltage output to the data line D4 is later than rising of the display voltage output to the data line D2, due to the characteristics of the NMOS transistor. Thus, a potential of the common electrode maybe varied and noise may be generated in the display panel.

At a timing 9 (t9), the time division switch control signal ASW1 becomes a high level state. A negative written voltage is applied to the input terminal 5*a*, and a positive written voltage is applied to the input terminal 5*b*. Thus, the negative written voltage is input to the data line D1, and the positive written voltage is input to the data line D3. Thus, in the same manner, a potential of the common electrode may be varied and noise may be generated in the display panel.

At a timing 10 (t10), the time division switch control signal ASW2 becomes a high level state. A negative written voltage is applied to the input terminal 5*a*, and a positive written voltage is applied to the input terminal 5*b*. Thus, the positive written voltage is input to the data line D4, and the negative written voltage is input to the data line D2. Thus, in the same manner, a potential of the common electrode may be varied and noise may be generated in the display panel. A subsequent operation repeats the operation during four horizontal periods, and thus description thereof will be omitted.

In view of the above problems, one object of one or more embodiments of the present invention is to provide a display device which can suppress voltage variations of a common electrode due to negative writing and positive writing of a data signal and negative voltage precharge and positive voltage precharge, and as a result so as to suppress generating noise in a panel surface.

One or more embodiments of the present invention relates to the following (1)-(7):

(1) A display device includes a plurality of pixels each of which has a transistor, a pixel electrode connected to the transistor, and a reference electrode disposed so as to be opposite to the pixel electrode. The plurality of pixels are arranged in a matrix. The display device also includes a plurality of gate lines that are respectively connected to the plurality of pixels, a plurality of data lines that are respectively connected to the plurality of pixels, a gate circuit that sequentially outputs gate signals to the plurality of gate lines, a driver that includes a data circuit generating data signals, which have different polarities, according to gray-scale values, for each predetermined horizontal period, and a data selector circuit that includes a plurality of switch groups each of which has a time division switch and a timing adjustment switch that are connected in parallel. The data selector circuit outputs output signals from the driver, which have different polarities every one or more data lines of the plurality of data lines, to the respective data lines via the switch groups respectively connected to the data lines. Each of the time division switches and the timing adjustment switches is an NMOS transistor. The driver turns on the timing adjustment switches, which are included in the switch groups connected to the data lines to which positive output signals are output from the driver, earlier than the time division switches, which are included in the switch groups connected to the data lines to which negative output signals are output from the driver, by a predetermined period, among the plurality of data lines.

(2) In the display device set forth in (1), the output signals are data signals output from the driver.

(3) In the display device set forth in (1) or (2), the output signals include positive and negative precharge signals. The positive and negative precharge signals are output from the driver and are applied to the respective pixels before the data signals are written in the respective pixels. The positive and negative precharge signals have a voltage value larger than a voltage value of the data signals in terms of an absolute value.

(4) In the display device set forth in any one of (1) to (3), the data selector circuit includes a plurality of input terminals to which output signals from the driver are input, and each of the input terminals is connected to two switch groups of the plurality of switch groups.

(5) In the display device set forth in any one of (1) to (3), the data selector circuit includes a plurality of input terminals to which output signals from the driver are input, and each of the input terminals is connected to three switch groups of the plurality of switch groups.

(6) In the display device set forth in any one of (1) to (5), during a first horizontal period, the driver applies the precharge voltages having one of positive and negative polarities to the respective data lines, and applies data signals having the other polarity after applying a reference voltage.

(7) In the display device set forth in (6), during a second horizontal period after the first horizontal period, the driver applies data signals which have the same polarity as the data signals which have been applied during the first horizontal period, to the respective data lines.

(8) In the display device set forth in (7), during the second horizontal period, the driver turns off the timing adjustment switches included in the respective switch groups.

(9) In the display device set forth in any one of (1) to (8), the driver outputs a reference voltage before a period for writing the data signals.

(10) In the display device set forth in any one of (1) to (9), the predetermined period is 0 ns to 50 ns.

DETAILED DESCRIPTION OF THE INVENTION

Figure 1:
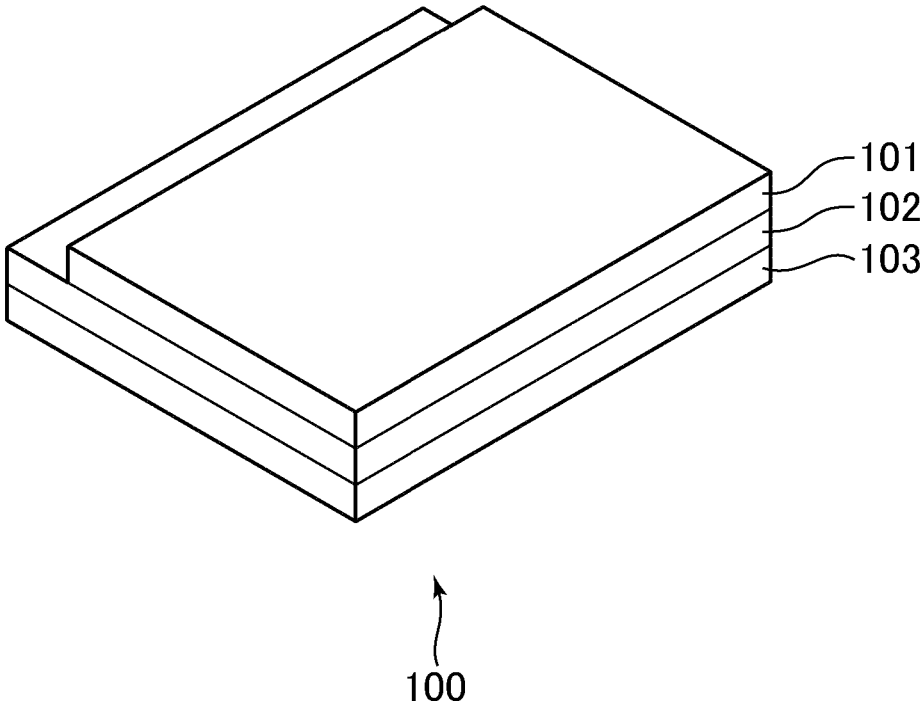
FIG. 1 is a diagram illustrating an outline of the display device according to a first embodiment of the present invention.

Hereinafter, embodiments of the present invention will be described with reference to the drawings. In addition, in the drawings, the same or equivalent elements are given the same reference numerals, and repeated description will be omitted.

[First Embodiment]

FIG. 1 is a diagram illustrating an outline of the display device according to the first embodiment of the present invention. As shown in FIG. 1, for example, a display device 100 includes a TFT substrate 102 provided with TFTs (not shown) and the like, and a filter substrate 101 which is opposite to the TFT substrate 102 and is provided with color filters (not shown). In addition, the display device 100 includes a liquid crystal material (not shown), which is sealed in a region interposed between the TFT substrate 102 and the filter substrate 101, and a backlight 103, which is located so as to come into contact with an opposite side of the filter substrate 101 side of the TFT substrate 102.

Figure 2:
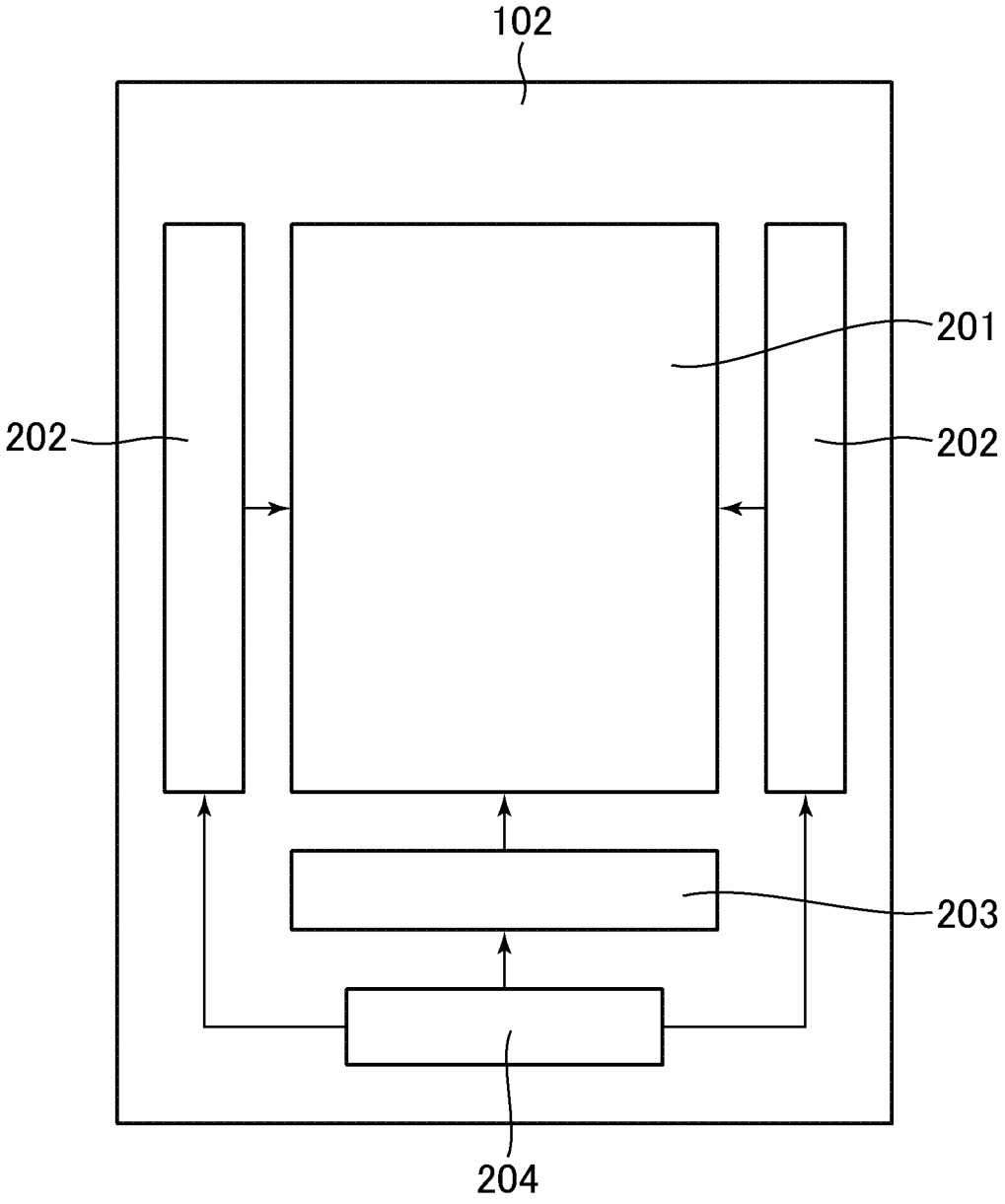
FIG. 2 is a diagram illustrating an outline of the configuration of the display device according to the first embodiment.

FIG. 2 is a diagram illustrating an outline of the configuration of the display device of one or more embodiments of the present invention. As shown in FIG. 2, the display device 100 includes a display region 201, gate circuits 202, a data selector circuit 203, and a driver 204.

The display region 201 includes plural pixel circuits described later arranged in a matrix. The gate circuits 202 sequentially output gate signals to plural gate lines extending from the gate circuits 202. The driver 204 outputs display signals according to grayscale values to plural pixel circuits provided in the display region 201 via the data selector circuit 203, and controls the gate circuits 202 and the data selector circuit 203 as described later. The data selector circuit 203 includes plural time division switches, and outputs data signals, which are output from the driver 204, to the respective data lines, in response to control signals from the driver 204. In addition, details of the display region 201, the gate circuits 202, the data selector circuit 203, the driver 204, and the like will be described later. The configuration shown in FIG. 2 is only an example, and the present invention is not limited thereto. For example, the driver 204, the data selector circuit 203, and the like may be constituted by one chip such as an IC.

Figure 3:
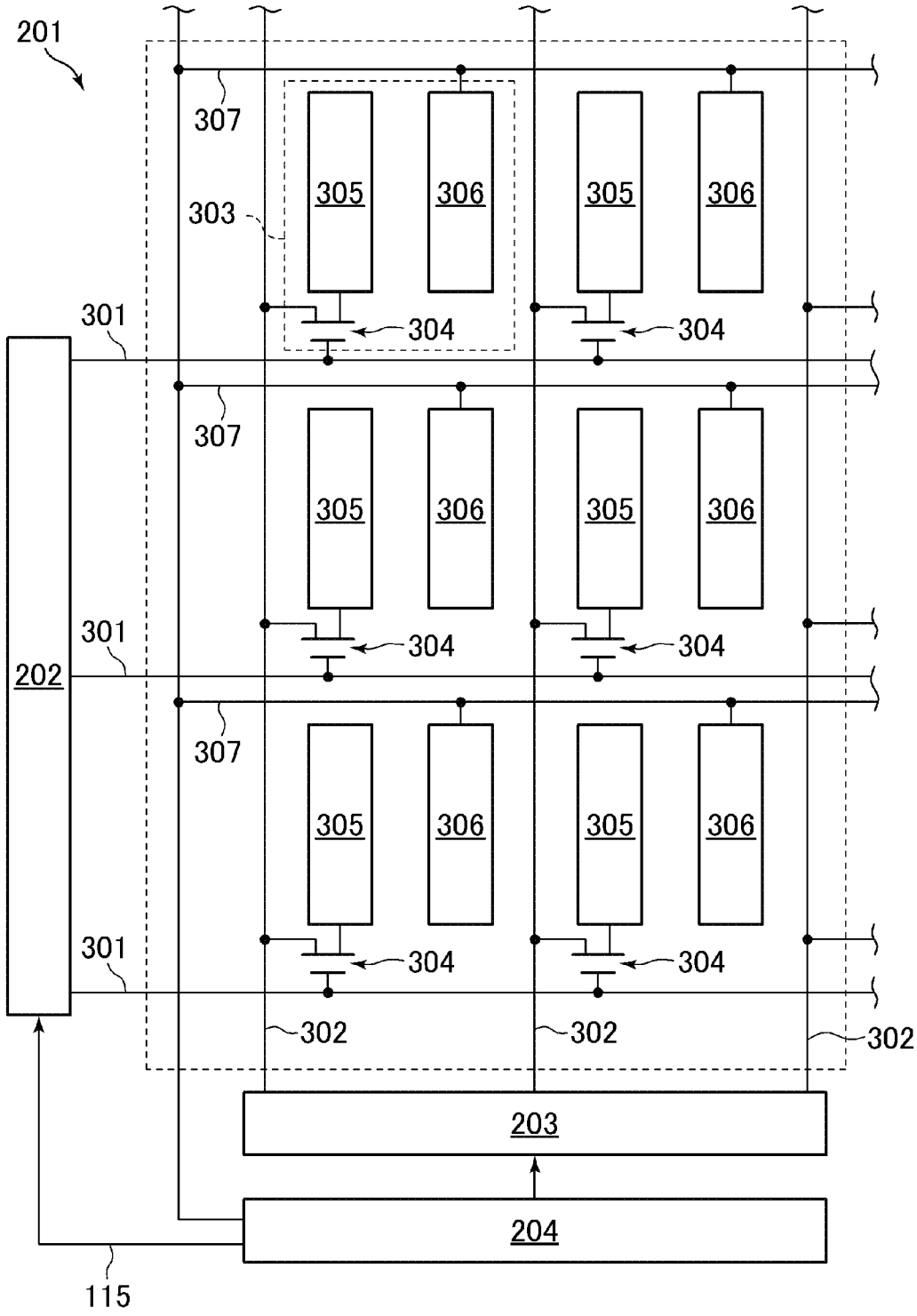
FIG. 3 is a diagram illustrating a configuration of the display region according to the first embodiment.

FIG. 3 is a diagram illustrating a configuration of the display region. As shown in FIG. 3, the TFT substrate 102 includes plural gate lines 301, which are arranged with the substantially equal interval in the horizontal direction of FIG. 2, and plural data lines 302, which are arranged with the substantially equal interval in the vertical direction of FIG. 2. The gate lines 301 are connected to the gate circuit 202, and the data lines 302 are connected to the driver 204 via the data selector circuit 203.

The gate circuit 202 has plural basic circuits (not shown) respectively corresponding to plural gate lines 301. In addition, each of the basic circuits outputs a gate signal, which becomes a high voltage level during a gate scanning period (high signal period) and becomes a low voltage level during the remaining period (low signal period) in one frame period, to the corresponding gate line 301, in response to control signals 115 from the driver 204.

Each of the pixel circuit 303, which is partitioned in a matrix by the gate lines 301 and the data lines 302, includes a TFT 304, a pixel electrode 305, and a common electrode 306. Here, a gate of the TFT 304 is connected to the gate line 301, an input side (one of the source and the drain) thereof is connected to the data line 302, and an output side (the other thereof) is connected to the pixel electrode 305. In addition, the common electrode 306 is connected to a common signal line 307. The pixel electrode 305 is opposite to the common electrode 306.

Next, an operation of the pixel circuit 303 as described above will be described. The driver 204 applies a reference voltage to the common electrode 306 via the common signal line 307. In addition, the gate circuit 202 controlled by the driver 204 outputs a gate signal to the gate electrode of the TFT 304 via the gate line 301. The driver 204 controls the data selector circuit 203 so as to supply a data signal corresponding to a grayscale value or a precharge voltage to the TFT 304 with which the gate signal has been output, via the data line 302. A voltage of the data signal or the precharge voltage is further applied to the pixel electrode 305 via the TFT 304. At this time, a potential difference occurs between the pixel electrode 305 and the common electrode 306.

The driver 204 controls a potential difference occurring between the pixel electrode 305 and the common electrode 306, so as to control alignment or the like of liquid crystal molecules of the liquid crystal material. Here, light from the backlight 103 is guided to the liquid crystal material, and the alignment or the like of the liquid crystal molecules is controlled as described above so as to control a light amount from the backlight 103, resulting in displaying images.

Figure 4:
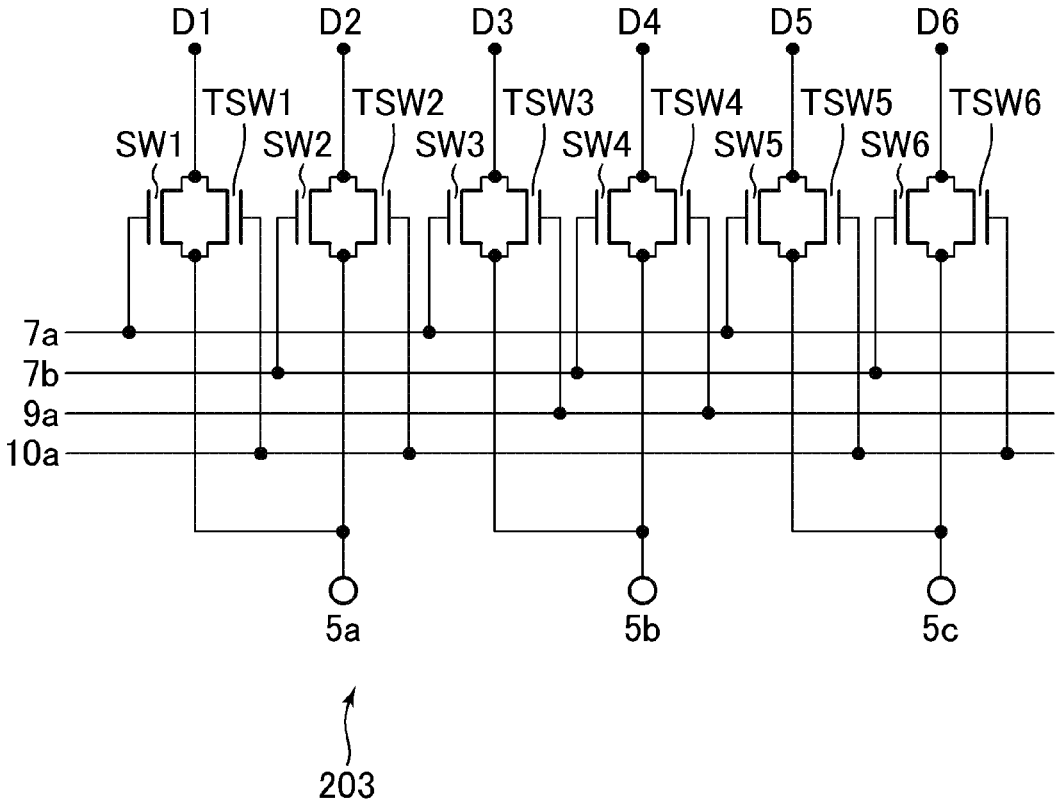
FIG. 4 is a diagram illustrating a configuration of the data selector circuit according to the first embodiment.

Next, an example of the configuration of the data selector circuit 203 according to the present embodiment will be described. FIG. 4 is a diagram illustrating a configuration of the data selector circuit according to the present embodiment. As shown in FIG. 4, the data selector circuit 203 includes plural input terminals 5*a* to 5*c* to which data signals are input from the driver 204, plural time division switches SW1 to SW6, and plural timing adjustment switches TSW1 to TSW6. Output sides of plural time division switches SW1 to SW6 and plural timing adjustment switches TSW1 to TSW6 are respectively connected to the data lines D1 to D6 (corresponding to the data lines 302). In addition, although FIG. 4 shows, for simplification of explanation, the three input terminals 5*a* to 5*c*, the six time division switches SW1 to SW6, the six timing adjustment switches TSW1 to TSW6, and the six data lines D1 to D6, the data selector circuit 203 according to the present embodiment is not limited thereto. The data lines D1 to D6 are sequentially connected to, for example, the pixel circuits 303 of RGB.

Each of the time division switches SW1 to SW6 is constituted by, for example, an NMOS transistor. One of the input terminals 5*a* to 5*c* from the driver 204 is connected to input sides of the two switches of the time division switches SW1 to SW6, and output sides of the switches are respectively connected to the two data lines 302. For example, the input terminal 5*a* is connected to the input sides of the two time division switches SW1 and SW2, and the output sides thereof are respectively connected to the data lines D1 and D2.

The gates of the odd numbered switches of plural time division switches SW1 to SW6, for example, the gates of the switches SW1 and SW3, are connected to a time division switch control line 7*a*. In addition, the gates of the odd numbered switches of plural time division switches SW1 to SW6, for example, the gates of the switches SW2 and SW4, are connected to a time division switch control line 7*b*.

Similarly, each of the timing adjustment switches TSW1 to TSW6 is constituted by, for example, an NMOS transistor. Each of the input terminals 5*a* to 5*c* from the driver 204 is connected to input sides of two switches of the timing adjustment switches TSW1 to TSW6, and output sides thereof are respectively connected to the data lines 302. For example, the input terminal 5*a* is connected to the input sides of the two timing adjustment switches TSW1 and TSW2, and the output sides thereof are respectively connected to the data lines D1 and D2.

The gates of the (4k−3)-th switches and the (4k−2)-th switches of plural timing adjustment switches TSW1 to TSW6, for example, the gates of the timing adjustment switches TSW1 and TSW2, are connected to a timing adjustment switch control line 10*a*. In addition, the gates of the (4k−1)-th switches and the 4k-th switches of plural timing adjustment switches TSW1 to TSW6, for example, the gates of the timing adjustment switches TSW3 and TSW4, are connected to a timing adjustment switch control line 9*a*. Here, k is a natural number equal to or more than 1.

In addition, one of the time division switches SW1 to SW6 is connected in parallel to one of the corresponding timing adjustment switches TSW1 to TSW6 with respect to one of the input terminals 5*a* to 5*c* and one of the corresponding data line 302. A set of one of the time division switches SW1 to SW6 and one of the corresponding timing adjustment switches TSW1 to TSW6 forms one switch group.

Figure 5:
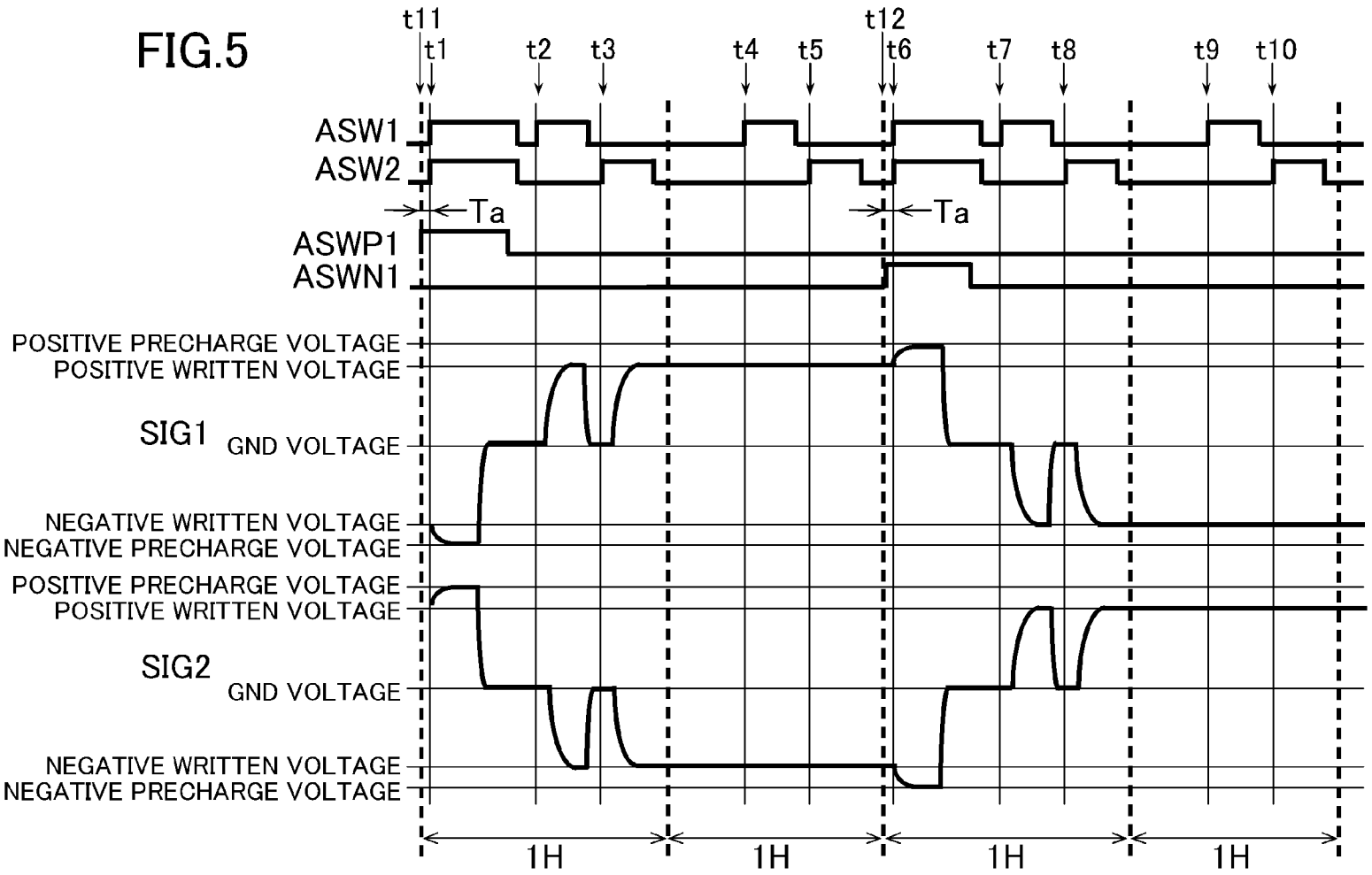
FIG. 5 is a diagram illustrating driving timings of the data selector circuit according to the first embodiment.

Next, a driving timing of the data selector circuit 203 will be described with reference to FIG. 5. In FIG. 5, SIG1 indicates a signal, which is input to the input terminal 5*a* from the driver 204, and SIG2 indicates a signal, which is input to the input terminal 5*b*. The time division switch control signal ASW1 indicates a signal input to the time division switch control line 7*a*, and the time division switch control signal ASW2 indicates a signal input to the time division switch control line 7*b*. The timing adjustment switch control signal ASWP1 indicates a signal input to the timing adjustment switch control line 9*a*, and the timing adjustment switch control signal ASWN1 indicates a signal input to the timing adjustment switch control line 10*a*.

First, at the timing 11 (t11), the timing adjustment switch control signal ASWP1 becomes a high level state, and the timing adjustment switch TSW3 and the timing adjustment switch TSW4 are turned on.

At the next timing 1 (t1), the time division switch control signal ASW1 and the time division switch control signal ASW2 becomes a high level state, and the time division switch SW1 and the time division switch SW2 are turned on. At this time, a negative precharge voltage is applied to the input terminal 5*a* and a positive precharge voltage is applied to the input terminal 5*b* from the driver 204. Thus, the negative precharge voltage is output to the data line D1 and the data line D2 via the time division switch SW1 and the time division switch SW2. In addition, the positive precharge voltage is output to the data lines D3 and D4 via the time division switch SW3, the time division switch SW4, the timing adjustment switch TSW3, and the timing adjustment switch TSW4.

Here, since the positive precharge voltage is input to the input sides of the time division switch SW3 and the time division switch SW4, signals of the output sides rise later than signals of the output sides of the time division switch SW1 and the time division switch SW2, to which the negative precharge voltage is input, due to the characteristics of the NMOS transistor as described above. However, the timing adjustment switch TSW3 and the timing adjustment switch TSW4 are turned on earlier than the time division switch SW1 and the time division switch SW2 by a predetermined period, for example, a Ta period, thereby suppressing a time difference due to the delay of the rising. In other words, it is possible to reduce a difference between the absolute voltage values of a negative precharge voltage output to the data line D1 and the data line D2 and a positive precharge voltage output to the data line D3 and the data line D4.

Figure 6A:
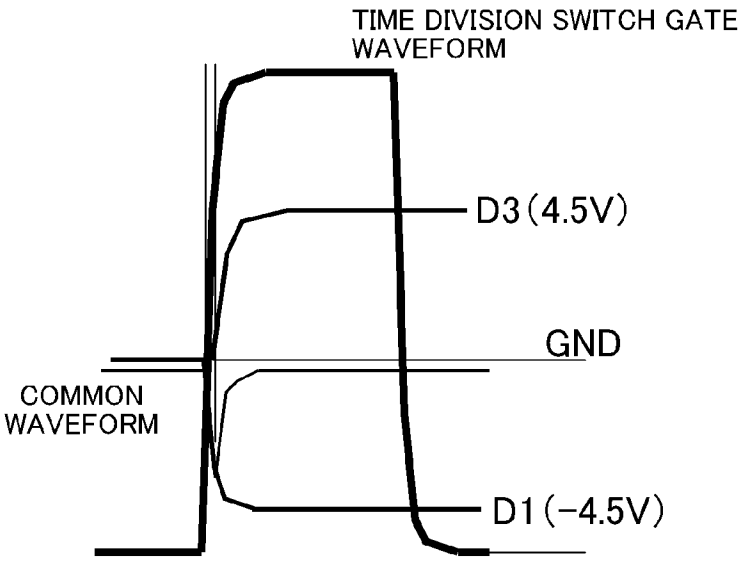
FIGS. 6A and 6B are diagrams illustrating effects achieved by the display device according to the first embodiment.

More specifically, as shown in FIG. 6A, for example, in a case where the above-described timing adjustment switches TSW1 to TSW6 are not provided, rising of the negative precharge voltage output to the data line D1 is earlier than rising of the positive precharge voltage output to the data line D3. Therefore, the rising difference varies a voltage of the common electrode 306.

Figure 6B:
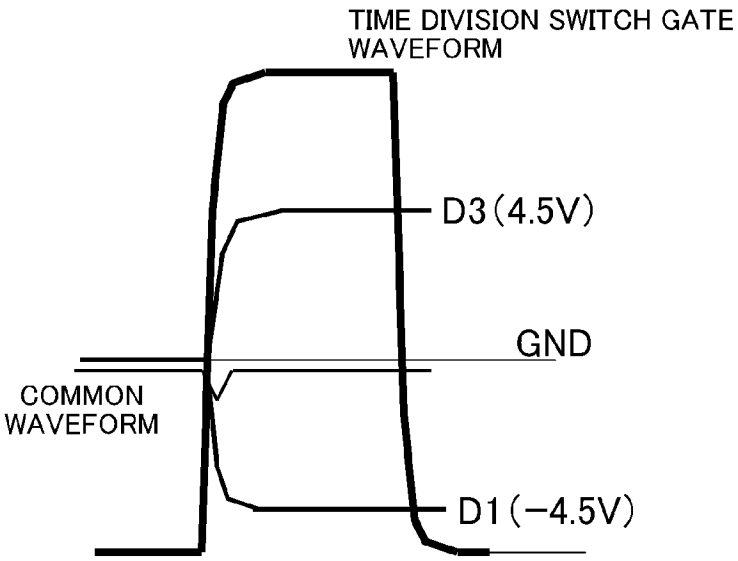

However, as described above, the timing adjustment switches TSW1 to TSW6 are provided, and the timing adjustment switches TSW1 to TSW6 are turned on earlier than the time division switches SW1 to SW6 by a predetermined period, so as to suppress the rising difference. Specifically, as shown in FIG. 6B, the timing adjustment switch TSW3 corresponding to the data line D3 is turned on earlier than the time division switch SW3 or the like, rising of a positive precharge voltage output to the data line D3 can be made to be the same as rising of a negative precharge voltage output to the data line D1. Thus, it is possible to suppress a potential variation of the common electrode as compared with the potential variation of the common electrode shown in FIG. 6A.

At the timing 2 (t2), the time division switch control signal ASW1 becomes a high level state. In addition, a positive written voltage from the GND voltage is applied to the input terminal 5*a*, and a negative written voltage is applied to the input terminal 5*b*. Thus, the positive written voltage is input to the data line D1, and the negative written voltage is input to the data line D3.

At the next timing 3 (t3), the time division switch control signal ASW2 becomes a high level state. In addition, a positive written voltage from the GND voltage is applied to the input terminal 5*a*, and a negative written voltage from the GND voltage is applied to the input terminal 5*b*. Thus, the positive written voltage is input to the data line D2, and the negative written voltage is input to the data line D4.

At the next timing 4 (t4), the time division switch control signal ASW1 becomes a high level state. In addition, a positive written voltage is applied to the input terminal 5*a*, and a negative written voltage is applied to the input terminal 5*b*. Thus, the positive written voltage is input to the data line D1, and the negative written voltage is input to the data line D3.

At the next timing 5 (t5), the time division switch control signal ASW2 becomes a high level state. In addition, a positive written voltage is applied to the input terminal 5*a*, and a negative written voltage is applied to the input terminal 5*b*. Thus, the positive written voltage is input to the data line D2, and the negative written voltage is input to the data line D4.

First, at the timing 12 (t12), the timing adjustment switch control signal ASWN1 becomes a high level state, and the timing adjustment switch TSW1 and the timing adjustment switch TSW2 are turned on.

At the next timing 6 (t6), the time division switch control signal ASW1 and the time division switch control signal ASW2 becomes a high level state, and the time division switch SW1, the time division switch SW2, the time division switch SW3, and the time division switch SW4 are turned on. At this time, a positive precharge voltage is applied to the input terminal 5*a* and a negative precharge voltage is applied to the input terminal 5*b*. Thus, the positive precharge voltage is output to the data line D1 to the data line D2 via the time division switch SW1, the time division switch SW2, the timing adjustment switch TSW1, and the timing adjustment switch TSW2. In addition, the negative precharge voltage is output to the data lines D3 and D4 via the time division switch SW3 and the time division switch SW4.

Here, since the positive precharge voltage is input to the input sides of the time division switch SW1 and the time division switch SW2, signals of the output sides rises later than signals of the output sides of the time division switch SW3 and the time division switch SW4 to which the negative precharge voltage is input due to the characteristics of the NMOS transistor as described above. However, the timing adjustment switch TSW1 and the timing adjustment switch TSW2 are turned on earlier than the time division switches SW1 to SW4 by a predetermined period, for example, a Ta period, so as to suppress a time difference due to the delay of the rising. In other words, it is possible to reduce a difference between the absolute voltage values of a positive precharge voltage, which is output to the data line D1 and the data line D2, and a negative precharge voltage, which is output to the data line D3 and the data line D4. Thereafter, the input terminals are precharged with the GND voltage.

At the next timing 7 (t7), the time division switch control signal ASW1 becomes a high level state. In addition, a negative written voltage from the GND voltage is applied to the input terminal 5*a*, and a positive written voltage from the GND voltage is applied to the input terminal 5*b*. Thus, the negative written voltage is input to the data line D1, and the positive written voltage is input to the data line D3.

At the next timing 8 (t8), the time division switch control signal ASW2 becomes a high level state. In addition, a negative written voltage from the GND voltage is applied to the input terminal 5*a*, and a positive written voltage from the GND voltage is applied to the input terminal 5*b*. Thus, the negative written voltage is input to the data line D2, and the positive written voltage is input to the data line D4.

At the next timing 9 (t9), the time division switch control signal ASW1 becomes a high level state. In addition, a negative written voltage is applied to the input terminal 5*a*, and a positive written voltage is applied to the input terminal 5*b*. Thus, the negative written voltage is input to the data line D1, and the positive written voltage is input to the data line D3.

At the next timing 10 (t10), the time division switch control signal ASW2 becomes a high level state. In addition, a negative written voltage is applied to the input terminal 5*a*, and a positive written voltage is applied to the input terminal 5*b*. Thus, the negative written voltage is input to the data line D2, and the positive written voltage is input to the data line D4.

Figure 16:
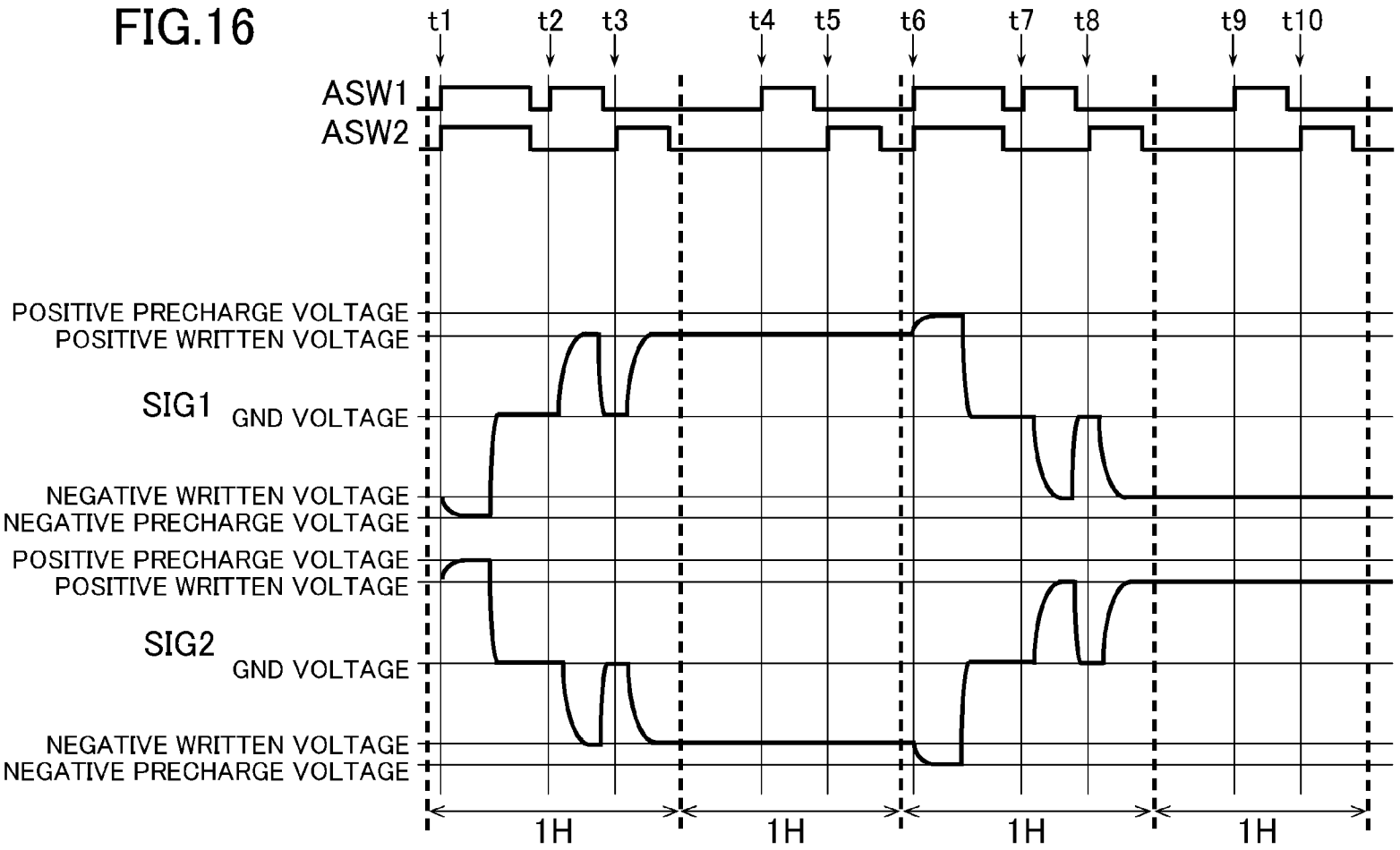
FIG. 16 is a diagram illustrating a driving timing of the data selector circuit shown in FIG. 15.

The above-described operation during four horizontal periods is repeatedly performed after the timing 10 (t10), and thus description thereof will be omitted. Here, in the above description, a period corresponding to one horizontal period is the same as that shown in FIG. 16, and, for example, the period from the timing 11 to the timing 12 corresponds to two horizontal periods. In addition, similarly, for simplification of explanation, the data signals SIG1 and SIG2 input to the data lines D1 to D6 have been described as predetermined voltages (for example, corresponding to white display or black display).

With the above-described configuration, when positive and negative precharge is performed, a difference as to rising of signals between the time division switches SW1 to SW6 can be suppressed, and thus it is possible to suppress occurrence of noise in the display panel.

Figure 7:
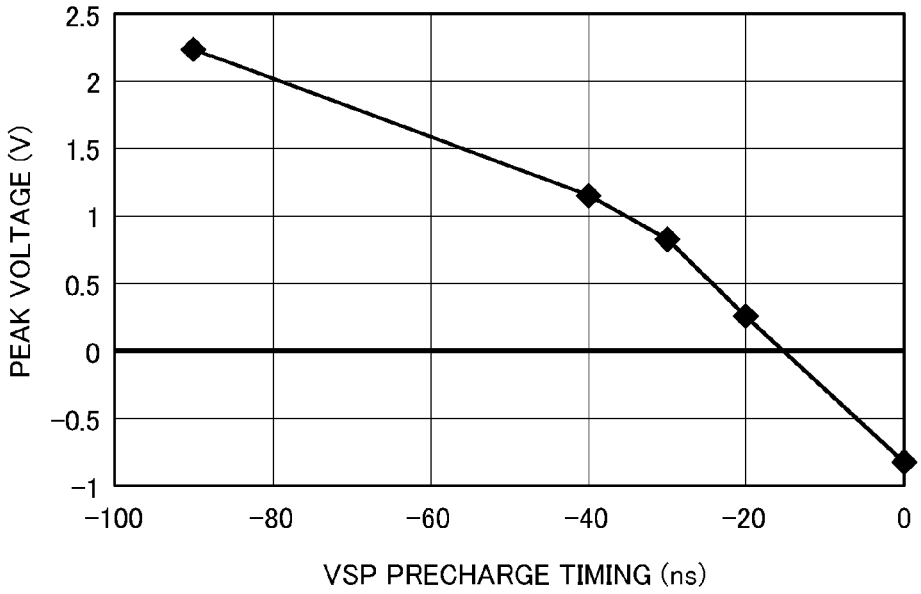
FIG. 7 is a diagram illustrating a relationship between a predetermined period and the common electrode according to the first embodiment.

Specifically, FIG. 7 shows a relationship between the predetermined period Ta and the common electrode 306 in a case of using the above-described embodiment an example. In FIG. 7, the longitudinal axis indicates a peak voltage of the common electrode 306, and the transverse axis indicates a time difference from the timing 1 to the timing 11. An absolute value thereof corresponds to Ta. As can be seen from FIG. 7, by adjusting Ta to be, for example, 0 ns to 50 ns, the peak voltage of the common electrode 306 can be effectively removed. In addition, according to the above-described embodiment, a size of a display panel can also be minimized as compared with a panel which does not have RGB switches. Further, when the display device according to the present embodiment includes a touch panel mounted thereon, it is also possible to prevent touch panel operation errors due to panel surface noise.

In addition, the present invention is not limited to the above-described embodiment and may be variously modified. For example, the present invention may be replaced with configurations which are substantially the same as the configurations indicated by the above-described embodiment, configurations achieving the same operations and effects, or configurations capable of achieving the same object.

[Second Embodiment]

Next, a second embodiment of the present invention will be described. The second embodiment is mainly different from the first embodiment in that polarities are reversed for each data line when precharge and writing are performed in the data selector circuit 203. In addition, in the following, description of the same configuration as in the first embodiment will be omitted.

Figure 8:
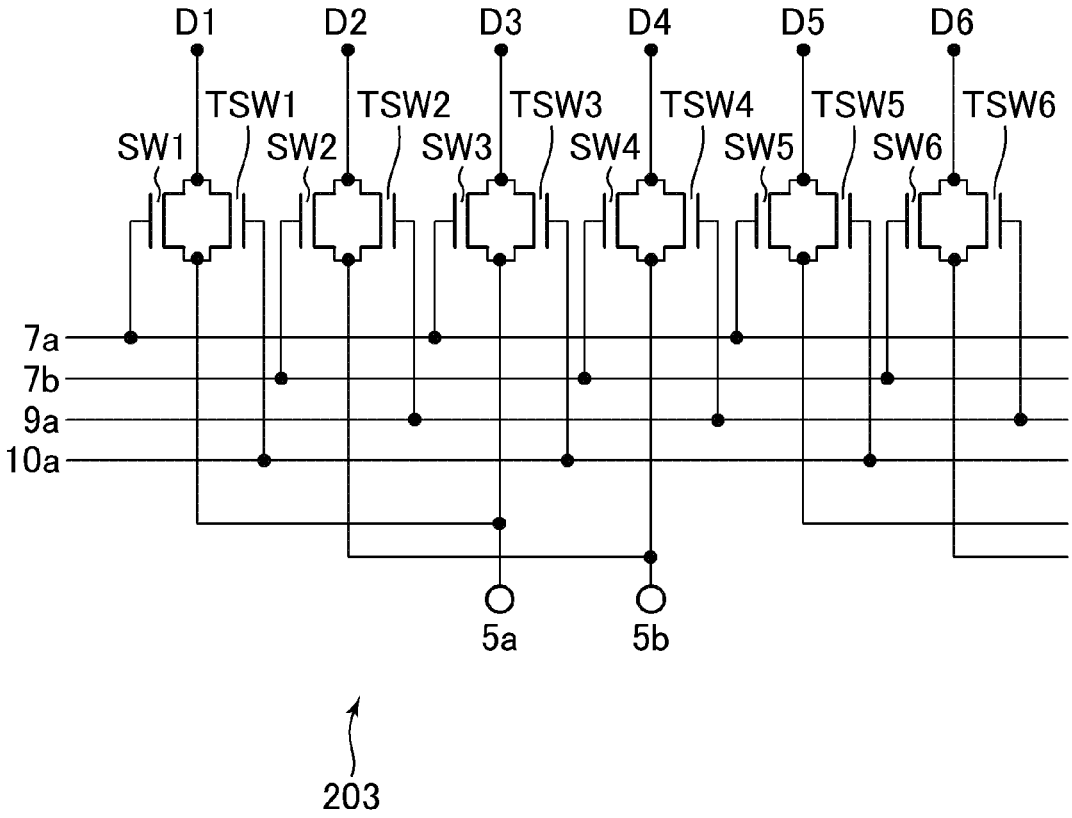
FIG. 8 is a diagram illustrating a configuration of the data selector circuit according to a second embodiment.

FIG. 8 is a diagram illustrating an example of the data selector circuit according to the second embodiment. As shown in FIG. 8, similarly to the first embodiment, the data selector circuit 203 includes input terminals 5*a* and 5*b* to which data signals are input from the driver 204, plural time division switches SW1 to SW6, and plural timing adjustment switches TSW1 to TSW6. Output sides of plural time division switches SW1 to SW6 and plural timing adjustment switches TSW1 to TSW6 are respectively connected to the data lines D1 to D6 (corresponding to the data lines 302). In addition, although FIG. 8 shows, for simplification of explanation, only a portion of the switches SW1 to SW6 and the like, the data selector circuit 203 according to the present embodiment is not limited thereto.

In the present embodiment, similarly to the first embodiment, one of the input terminals 5*a* and 5*b* from the driver 204 is connected to input sides of two switches of the time division switches SW1 to SW6, and output sides of the switches are respectively connected to the two data lines D1 to D6. However, in the present embodiment, one of the input terminals 5*a* and 5*b* from the driver 204 is connected to the input sides of two switches disposed every other line of the time division switches SW1 to SW6 arranged in line. For example, the input terminal 5*a* is connected to the input sides of the time division switch SW1 and the time division switch SW3 and the output sides thereof are respectively connected to the data line D1 and the data line D3.

The gates of the odd numbered switches of plural time division switches SW1 to SW6, for example, the gates of the switches SW1 and SW3, are connected to a time division switch control line 7*a*. In addition, the gates of the odd numbered switches of plural time division switches SW1 to SW6, for example, the gates of the switches SW2 and SW4, are connected to a time division switch control line 7*b*.

Similarly to the first embodiment, one of the input terminals 5*a* and 5*b* from the driver 204 is connected to input sides of two switches of the timing adjustment switches TSW1 to TSW6, and output sides thereof are respectively connected to the two data lines D1 to D6. However, in the present embodiment, one of the input terminals 5*a* and 5*b* from the driver 204 is connected to the input sides of two switches disposed every other line of the timing adjustment switches TSW1 to TSW6 arranged in line. For example, the input terminal 5*a* is connected to the input sides of the timing adjustment switch TSW1 and the timing adjustment switch TSW3, and the output sides thereof are respectively connected to the data line D1 and the data line D3.

The gates of the odd numbered switches of plural timing adjustment switches TSW1 to TSW6, for example, the gates of the timing adjustment switches TSW1 and TSW3, are connected to a timing adjustment switch control line 10*a*. In addition, the gates of the even numbered switches of plural timing adjustment switches TSW1 to TSW6, for example, the gates of the timing adjustment switches TSW2 and TSW4, are connected to a timing adjustment switch control line 9*a*. A driving timing of the data selector circuit 203 is the same as that in the first embodiment, and thus a description thereof will be omitted.

According to the present embodiment, similarly to the first embodiment, when positive and negative precharge is performed, a difference as to rising of signals between the time division switches can be suppressed, and thus it is possible to suppress occurrence of noise in the display panel.

[Third Embodiment]

Next, a third embodiment of the present invention will be described. The third embodiment is mainly different from the first embodiment in that each of the input terminals 5*a* and 5*b*, to which a data signal is input from the driver 204, is divided into three, the data signal is input to corresponding time division switches SW1 to SW6, and polarities are reversed for each of the data lines D1 to D6 when precharge voltages and data signals are written, in a configuration of the data selector circuit 203. In addition, in the following, description of the same configuration as in the first embodiment will be omitted.

Figure 9:
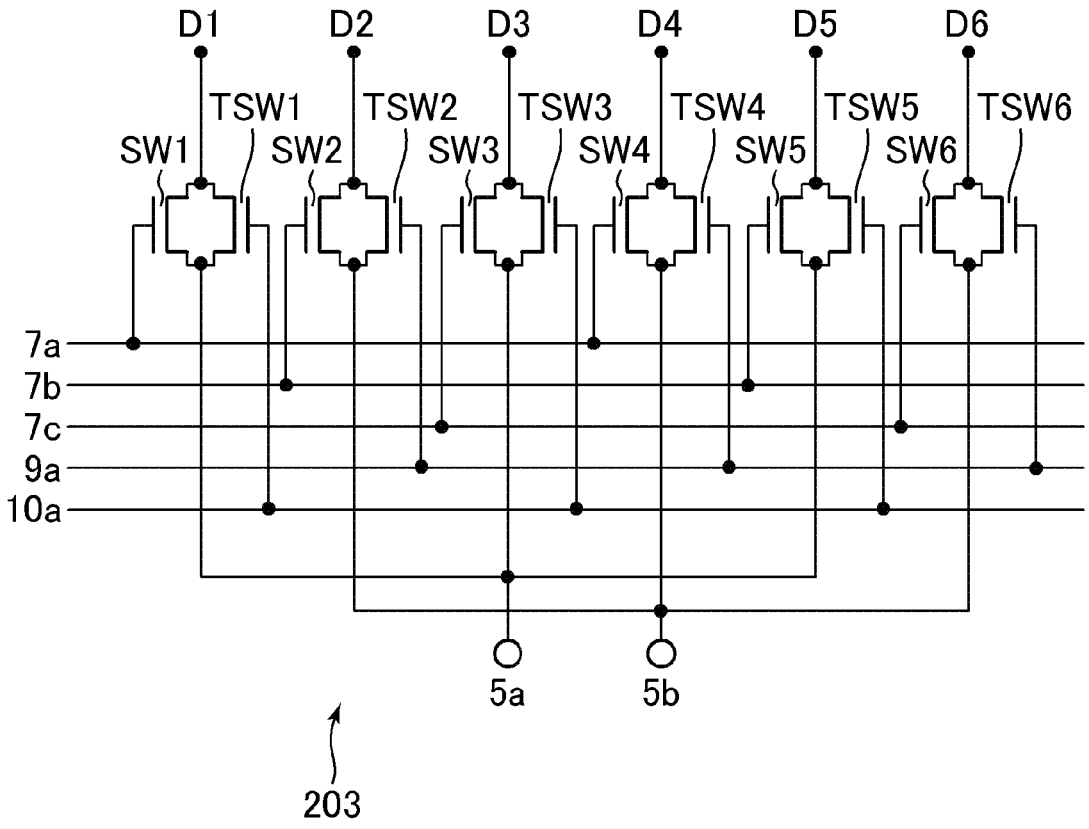
FIG. 9 is a diagram illustrating a configuration of the data selector circuit according to a third embodiment.

FIG. 9 is a diagram illustrating an example of the data selector circuit according to the third embodiment. In the present embodiment, similarly to the first embodiment, the data selector circuit 203 includes input terminals 5*a* and 5*b* to which data signals are input from the driver 204, plural time division switches SW1 to SW6, and plural timing adjustment switches TSW1 to TSW6. Plural time division switches SW1 to SW6 and plural timing adjustment switches TSW1 to TSW6 are respectively connected to the data lines D1 to D6.

As shown in FIG. 9, one of the input terminals 5*a* and 5*b* from the driver 204 is connected to input sides of three switches of the time division switches SW1 to SW6, and output sides of the switches are respectively connected to the three data lines D1 to D6. One of the input terminals 5*a* and 5*b* from the driver 204 is connected to the input sides of three switches disposed every other line of the time division switches SW1 to SW6 arranged in line. For example, the input terminal 5*a* is connected to the input sides of the time division switch SW1, the time division switch SW3, and the time division switch SW5, and the output sides thereof are respectively connected to the data lines D1, D3 and D5.

The gates of the (3k−2)-th switches of plural time division switches SW1 to SW6, for example, the gates of the time division switch SW1, the time division switch SW4, and the like, are connected to a time division switch control line 7*a*. In addition, the gates of the (3k−1)-th switches of plural time division switches, for example, the gates of the time division switches SW2 and SW5, and the like, are connected to a time division switch control line 7*b*. Further, the gates of the 3k-th switches of plural time division switches SW1 to SW6, for example, the gates of the time division switches SW3 and SW6, and the like, are connected to a time division switch control line 7*c*. Here, k is a natural number equal to or more than 1.

Similarly, one of the input terminals 5*a* and 5*b* from the driver 204 is connected to input sides of three switches of the timing adjustment switches TSW1 to TSW6, and output sides thereof are respectively connected to the three data lines D1 to D6. One of the input terminals 5*a* and 5*b* from the driver 204 is connected to input sides of three switches disposed every other line of the timing adjustment switches TSW1 to TSW6 arranged in line. For example, the input terminal 5*a* is connected to the input sides of the timing adjustment switches TSW1, TSW3, and TSW5, and the output sides thereof are respectively connected to the data lines D1, D3 and D5.

The gates of the odd numbered switches of plural timing adjustment switches TSW1 to TSW6, for example, the gates of the timing adjustment switches TSW1 and TSW3, are connected to a timing adjustment switch control line 10*a*. In addition, the gates of the even numbered switches of plural timing adjustment switches TSW1 to TSW6, for example, the gates of the timing adjustment switches TSW2 and TSW4, are connected to a timing adjustment switch control line 9*a*. A driving timing is the same as that obtained by dividing the driving timing shown in FIG. 5 into three, and thus a description thereof will be omitted.

According to the present embodiment, when positive and negative precharge is performed, a difference as to rising of signals between the time division switches can be suppressed, and thus it is possible to suppress occurrence of noise in the display panel.

[Fourth Embodiment]

Next, a fourth embodiment of the present invention will be described. The fourth embodiment is mainly different from the first embodiment in a configuration of the data selector circuit 203. That is, a difference of rising of output signals that are output from the time division switches SW1 to SW6, which occur at the time of writing data signals, is suppressed using the timing adjustment switches TSW1 to TSW6 even at the time of writing data signals. In addition, in the following, description of the same configuration as in the first embodiment will be omitted.

Figure 10:
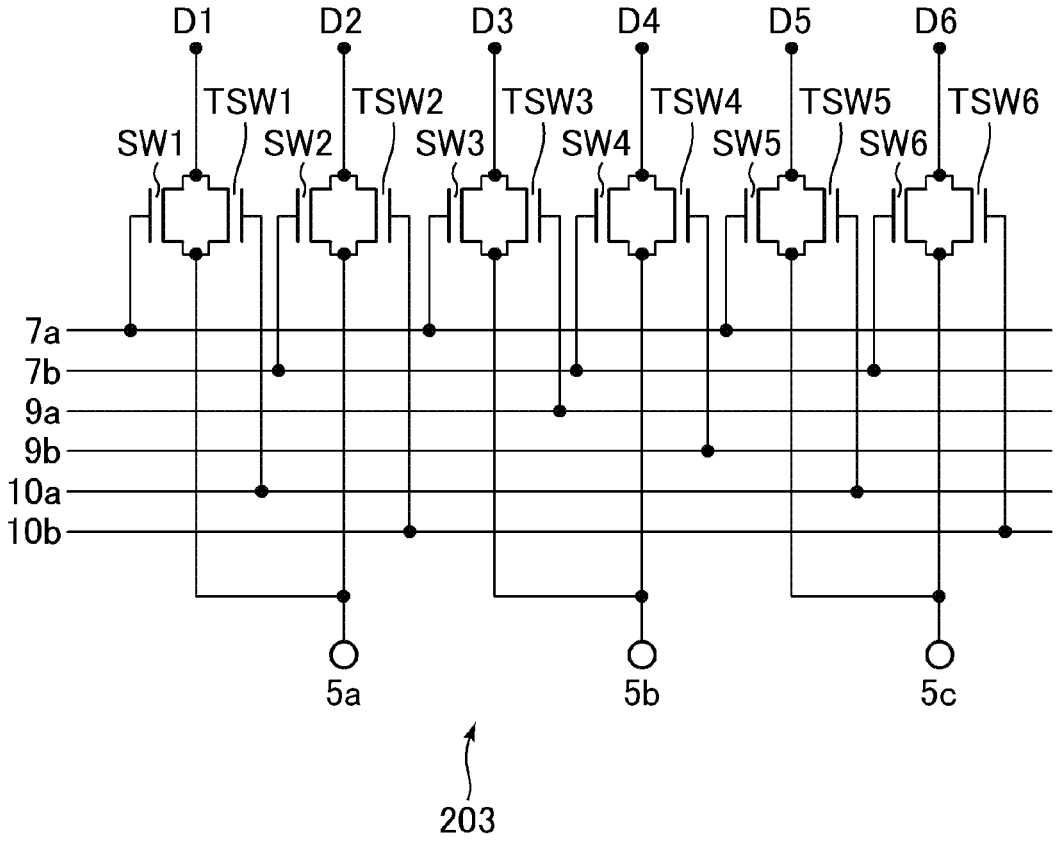
FIG. 10 is a diagram illustrating an example of the data selector circuit according to a fourth embodiment.

FIG. 10 is a diagram illustrating an example of the data selector circuit according to the present embodiment. Similarly to the first embodiment, the data selector circuit 203 according to the present embodiment includes plural input terminals 5*a* to 5*c* to which data signals are input from the driver 204, plural time division switches SW1 to SW6, and plural timing adjustment switches TSW1 to TSW6. Output sides of plural time division switches SW1 to SW6 and plural timing adjustment switches TSW1 to TSW6 are respectively connected to the data lines D1 to D6.

In the present embodiment, similarly to the first embodiment, one of the input terminals 5*a* to 5*c* from the driver 204 is divided into two and is connected to input sides of two switches of the time division switches SW1 to SW6 and of timing adjustment switches TSW1 to TSW6, and output sides of the switches are respectively connected to the two data lines D1 to D6. Specifically, for example, the input terminal 5*a* is connected to the input sides of the time division switches SW1 and SW2, and the output sides thereof are respectively connected to the data lines D1 and D2.

The gates of the odd numbered switches of plural time division switches SW1 to SW6, for example, the gates of the switches SW1 and SW3, are connected to a time division switch control line 7*a*. In addition, the gates of the even numbered switches of plural time division switches SW1 to SW6, for example, the gates of the switches SW2 and SW4, are connected to a time division switch control line 7*b*.

One of the input terminals 5*a* to 5*c* from the driver 204 is connected to input sides of two switches of the timing adjustment switches TSW1 to TSW6, and output sides thereof are respectively connected to the two data lines D1 to D6. For example, the input terminal 5*a* is connected to the input sides of the timing adjustment switches TSW1 and TSW2, and the output sides thereof are respectively connected to the data lines D1 and D2.

The gates of the (4k−3)-th switches from the left of FIG. 10 of plural timing adjustment switches TSW1 to TSW6, for example, the gates of the timing adjustment switches TSW1 and TSW5, and the like, are connected to a timing adjustment switch control line 10*a*. In addition, the gates of the (4k−2)-th switches of plural timing adjustment switches TSW1 to TSW6, for example, the gates of the timing adjustment switches TSW2 and TSW6, and the like, are connected to a timing adjustment switch control line 10*b*. Here, k is a natural number equal to or more than 1.

The gates of the (4k−1)-th switches of plural timing adjustment switches TSW1 to TSW6, for example, the gates of the timing adjustment switch TSW3 and the like, are connected to a timing adjustment switch control line 9*a*. In addition, the gates of the 4k-th switches of plural timing adjustment switches TSW1 to TSW6, for example, the gates of the timing adjustment switch TSW4 and the like, are connected to a timing adjustment switch control line 9*b*. Here, k is a natural number equal to or more than 1.

Figure 11:
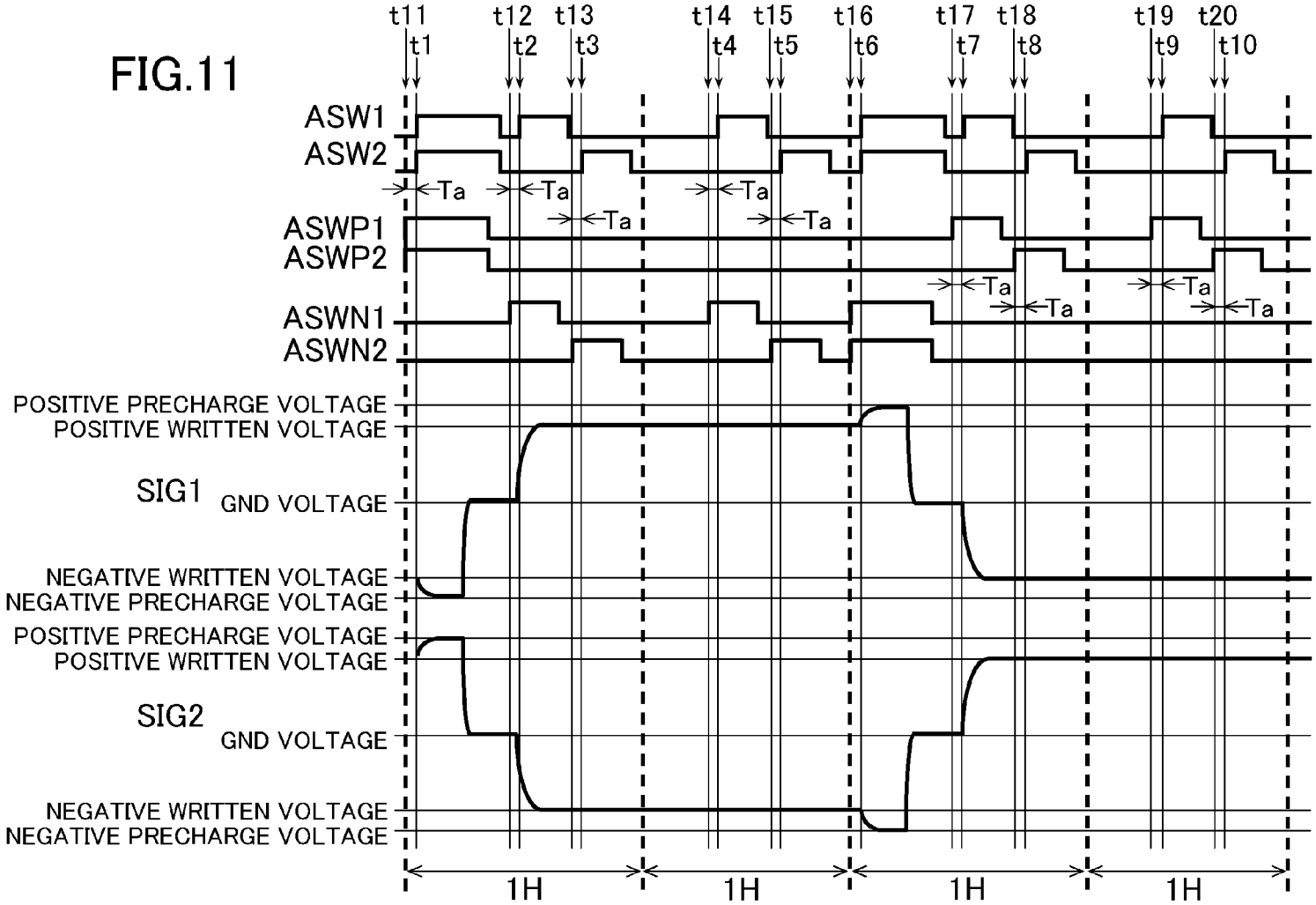
FIG. 11 is a diagram illustrating a driving timing of the data selector circuit according to the fourth embodiment.

Next, a driving timing of the data selector circuit 203 will be described with reference to FIG. 11. In FIG. 11, SIG1 indicates a signal which is input to the input terminal 5*a* from the driver 204, and SIG2 indicates a signal which is input to the input terminal 5*b*. The time division switch control signal ASW1 indicates a signal input to the time division switch control line 7*a*, and the time division switch control signal ASW2 indicates a signal input to the time division switch control line 7*b*. The timing adjustment switch control signal ASWP1 indicates a signal input to the timing adjustment switch control line 9*a*, and the timing adjustment switch control signal ASWP2 indicates a signal input to the timing adjustment switch control line 9*b*. The timing adjustment switch control signal ASWN1 indicates a signal input to the timing adjustment switch control line 10*a*, and the timing adjustment switch control signal ASWN2 indicates a signal input to the timing adjustment switch control line 10*b*.

First, at the timing 11 (t11), the timing adjustment switch control signal ASWP1 (hereinafter, referred to as ASWP1) and the timing adjustment switch control signal ASWP2 (hereinafter, referred to as ASWP2) become a high level state, and the timing adjustment switch TSW3 and the timing adjustment switch TSW4 are turned on.

At the next timing 1 (t1), the time division switch control signal ASW1 and the time division switch control signal ASW2 become a high level state, and the time division switches SW1 to SW6 are turned on. At this time, a negative precharge voltage is applied to the input terminal 5*a* and a positive precharge voltage is applied to the input terminal 5*b*. Thus, the negative precharge voltage is output to the data line D1 and the data line D2 via the time division switch SW1 and the time division switch SW2. In addition, the positive precharge voltage is output to the data lines D3 and D4 via the time division switch SW3, the time division switch SW4, the timing adjustment switch TSW3, and the timing adjustment switch TSW4.

Here, since the positive precharge voltage is input to the input sides of the time division switch SW3 and the time division switch SW4, signals at the output sides rises later than signals of the time division switch SW1 and the time division switch SW2 to which the negative precharge voltage is input due to the characteristics of the NMOS transistor as described above. However, the timing adjustment switch TSW3 and the timing adjustment switch TSW4 are turned on earlier than the time division switch SW1 and the time division switch SW2 by a predetermined period, for example, a Ta period, so as to suppress a time difference due to the delay of the rising. In other words, it is possible to reduce a difference between the absolute voltage values of a negative precharge voltage, which is output to the data line D1 and the data line D2, and a positive precharge voltage, which is output to the data line D3 and the data line D4.

At the timing 12 (t12), the timing adjustment switch control signal ASWN1 (hereinafter, referred to as ASWN1) becomes a high level state, and the timing adjustment switches TSW1 and TSW5 are turned on.

At the timing 2 (t2), the time division switch control signal ASW1 becomes a high level state. In addition, a positive written voltage from the GND voltage is applied to the input terminal 5*a*, and a negative written voltage is applied to the input terminal 5*b*. Thus, the positive written voltage is input to the data line D1, and the negative written voltage is input to the data line D3.

Here, since the positive written voltage is input to the input side of the time division switch SW1, signals at the output sides rises later than signals at the time division switch SW3 to which the negative written voltage is input due to the characteristics of the NMOS transistor as described above. However, the timing adjustment switch TSW1 is turned on earlier than the time division switch SW1 and the time division switch SW3 by a predetermined period, for example, a Ta period, so as to suppress a time difference due to the delay of the rising. In other words, it is possible to reduce a difference between the absolute voltage values of a positive written voltage, which is output to the data line D1, and a negative written voltage, which is output to the data line D3.

At the timing 13 (t13), the timing adjustment switch control signal ASWN2 (hereinafter, referred to as ASWN2) becomes a high level state, and the timing adjustment switches TSW2 and TSW6 are turned on.

At the next timing 3 (t3), the time division switch control signal ASW2 becomes a high level state. In addition, a positive written voltage is applied to the input terminal 5*a*, and a negative written voltage from the GND voltage is applied to the input terminal 5*b*. Thus, the positive written voltage is input to the data line D2, and the negative written voltage is input to the data line D4.

Here, since the positive written voltage is input to the input side of the time division switch SW4, signals at the output sides rises later than signals at the time division switch SW2 to which the negative written voltage is input due to the characteristics of the NMOS transistor as described above. However, the timing adjustment switch TSW2 is turned on earlier than the time division switch SW2 and the like by a predetermined period, for example, a Ta period, so as to suppress a time difference due to the delay of the rising. In other words, it is possible to reduce a difference between the absolute voltage values of a positive written voltage, which is output to the data line D2, and a negative written voltage, which is output to the data line D4.

At the timing 14 (t14), ASWN1 becomes a high level state, and the timing adjustment switches TSW1 and TSW5 are turned on.

At the next timing 4 (t4), the time division switch control signal ASW1 becomes a high level state. In addition, a positive written voltage is applied to the input terminal 5*a*, and a negative written voltage is applied to the input terminal 5*b*. Thus, the positive written voltage is input to the data line D1, and the negative written voltage is input to the data line D3.

Here, since the positive written voltage is input to the input side of the time division switch SW1, signals at the output sides rises later than signals at the time division switch SW3 and the like to which the negative written voltage is input due to the characteristics of the NMOS transistor as described above. However, the timing adjustment switch TSW1 is turned on earlier than the time division switch SW1 by a predetermined period, for example, a Ta period, so as to suppress a time difference due to the delay of the rising. In other words, it is possible to reduce a difference between the absolute voltage values of a positive written voltage, which is output to the data line D1, and a negative written voltage, which is output to the data line D3.

At the timing 15 (t15), ASWN2 becomes a high level state, and the timing adjustment switches TSW2 and TSW6 are turned on.

At the next timing 5 (t5), the time division switch control signal ASW2 becomes a high level state. In addition, a positive written voltage is applied to the input terminal 5*a*, and a negative written voltage is applied to the input terminal 5*b*. Thus, the positive written voltage is input to the data line D2, and the negative written voltage is input to the data line D4.

Here, since the positive written voltage is input to the input side of the time division switch SW2, signals at the output sides rise later than signals at the time division switch SW4 to which the negative written voltage is input due to the characteristics of the NMOS transistor as described above. However, the timing adjustment switch TSW2 is turned on earlier than the time division switch SW2 and the like by a predetermined period, for example, a Ta period, so as to suppress a time difference due to the delay of the rising. In other words, it is possible to reduce a difference between the absolute voltage values of a positive written voltage, which is output to the data line D2, and a negative written voltage, which is output to the data line D4.

An operation during the subsequent two horizontal periods is the same as that during the previous two horizontal periods except that polarities of written voltages and the like input to the input terminals are reversed, and thus description thereof will be omitted.

Figure 12:
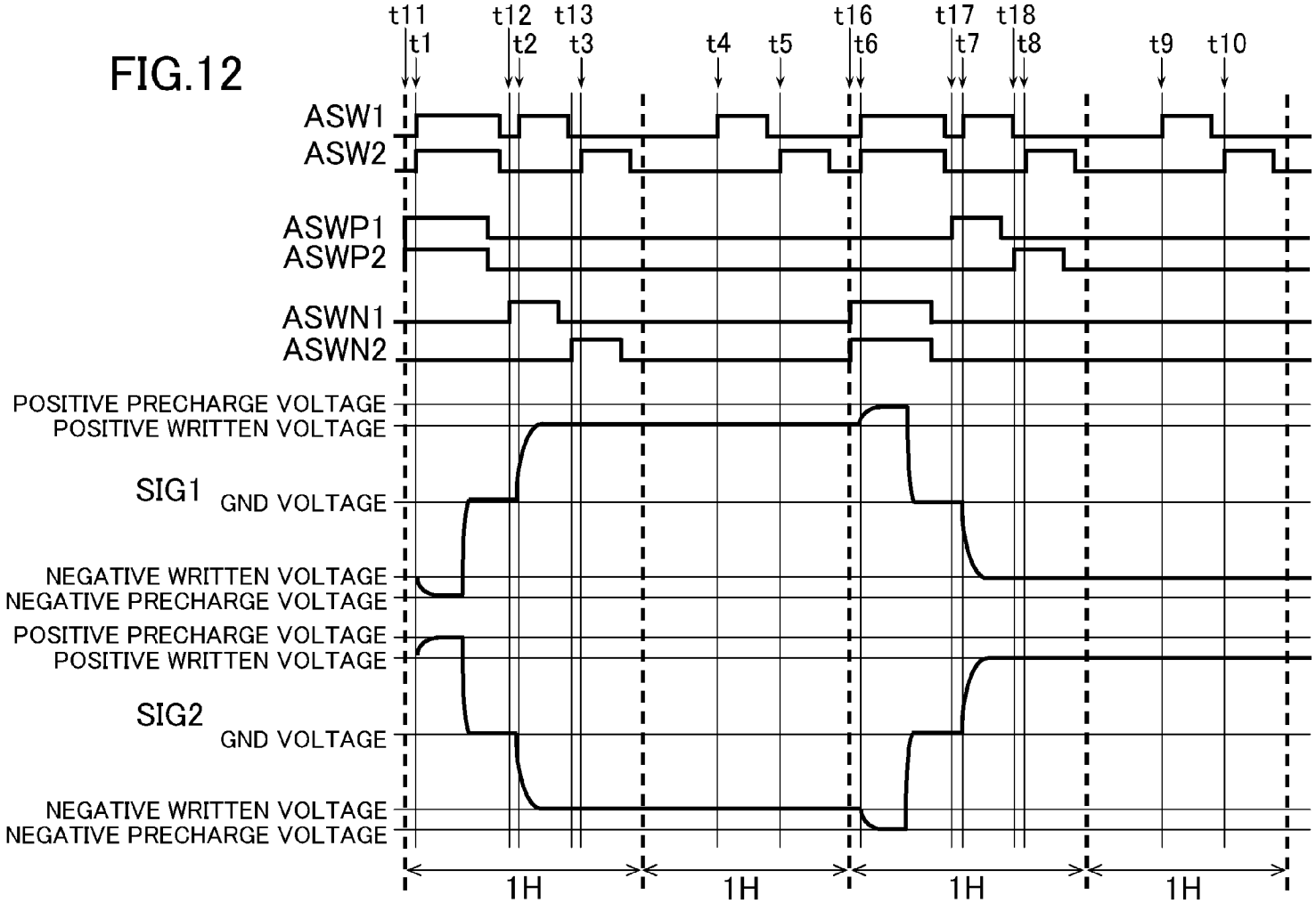
FIG. 12 is a diagram illustrating another driving timing of the data selector circuit according to the fourth embodiment.

In addition, in the present embodiment, a driving timing shown in FIG. 12 may be used instead of the driving timing shown in FIG. 11. The driving timing shown in FIG. 12 is different from that shown in FIG. 11 in that timing correction is not performed during the horizontal periods when polarity inversion is not performed. In this case, specifically, for example, timing correction is not performed during the even numbered horizontal periods shown in FIG. 11. In other words, for example, ASWP1, ASWP2, ASWN1, and ASWN2 are maintained in a low level state at the timing 14 and the timing 15, and the like in FIG. 11. More specifically, for example, the timing correction performed at the timing 14, the timing 15, the timing 19, and the timing 20 shown in FIG. 11 is not performed.

With the above-described configuration, when positive and negative precharge is performed, a difference as to rising of signals between the time division switches SW1 to SW6 can be suppressed, and thus it is possible to suppress occurrence of noise in the display panel.

[Fifth Embodiment]

Next, a fifth embodiment of the present invention will be described. The fifth embodiment is mainly different from the first embodiment in that each of the input terminals 5*a* and 5*b* of data signals or the like is connected to three switches of the time division switches SW1 to SW6, which are connected to corresponding data lines D1 to D6, and polarities of precharge voltages and written voltages are reversed for each of the data lines D1 to D6, in a configuration of the data selector circuit 203. In addition, in the following, description of the same configuration as in the first embodiment will be omitted.

Figure 13:
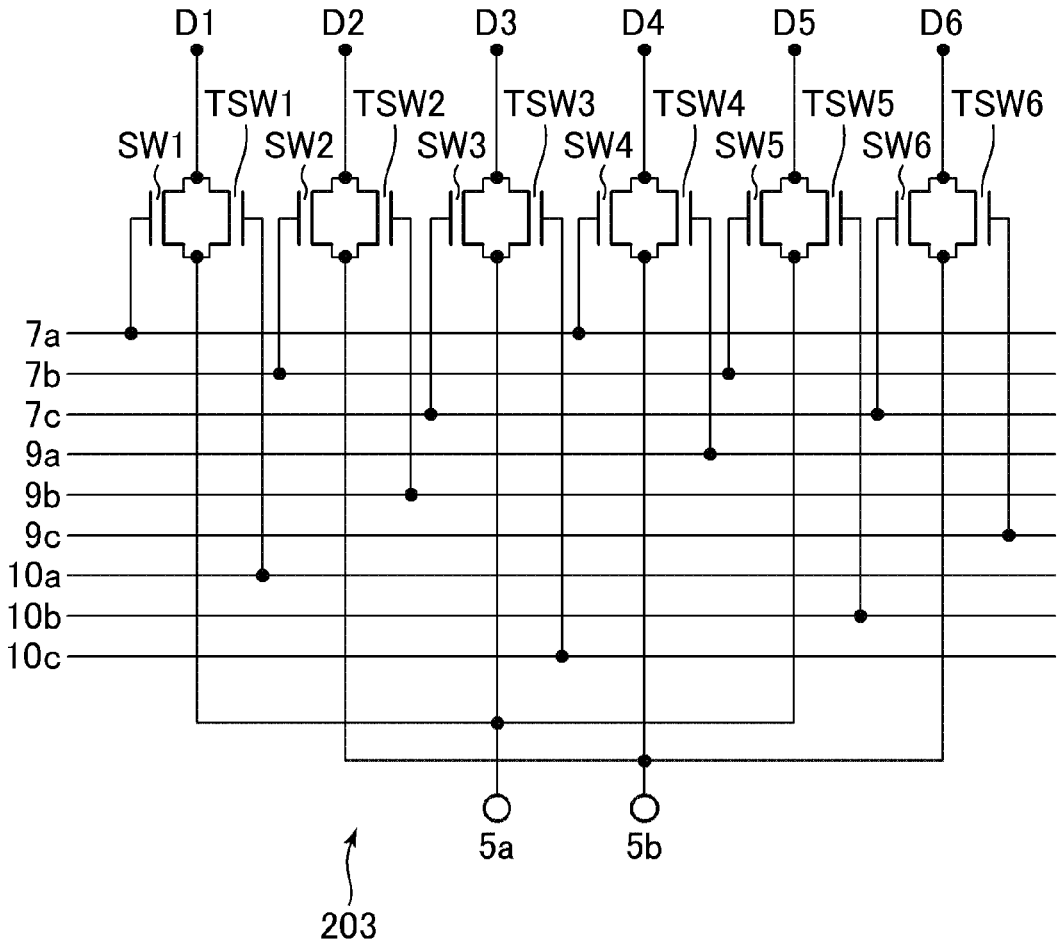
FIG. 13 is a diagram illustrating a configuration of the data selector circuit according to a fifth embodiment.

FIG. 13 is a diagram illustrating a configuration of the data selector circuit according to the fifth embodiment. Similarly to the third embodiment, one of the input terminals 5*a* and 5*b* from the driver 204 is connected to input sides of three switches of the time division switches SW1 to SW6, and the output sides of the switches are respectively connected to the three data lines D1 to D6. One of the input terminals 5*a* and 5*b* from the driver 204 is connected to the input sides of three switches disposed every other line of the time division switches SW1 to SW6 arranged in line. For example, the input terminal 5*a* is connected to the input sides of the time division switch SW1, the time division switch SW3, and the time division switch SW5, and the output sides thereof are respectively connected to the data lines D1, D3 and D5.

The gates of the (3k−2)-th switches of plural time division switches SW1 to SW6, for example, the gates of the time division switch SW1, the time division switch SW4, and the like, are connected to a time division switch control line 7*a*. In addition, the gates of the (3k−1)-th switches of plural time division switches SW1 to SW6, for example, the gates of the time division switches SW2 and SW5, and the like, are connected to a time division switch control line 7*b*. Further, the gates of the 3k-th switches of plural time division switches SW1 to SW6, for example, the gates of the time division switches SW3 and SW6, and the like, are connected to a time division switch control line 7*c*. Here, k is a natural number equal to or more than 1.

Similarly, one of the input terminals 5*a* and 5*b* from the driver 204 is connected to input sides of three switches of the timing adjustment switches TSW1 to TSW6, and output sides thereof are respectively connected to the three data lines D1 to D6. One of the input terminals 5*a* and 5*b* from the driver 204 is connected to input sides of three switches disposed every other line of the timing adjustment switches TSW1 to TSW6 arranged in line. For example, the input terminal 5*a* is connected to the input sides of the timing adjustment switches TSW1, TSW3 and TSW5, and the output sides thereof are respectively connected to the data lines D1, D3 and D5.

In addition, the gates of the (6k−5)-th switches of plural timing adjustment switches TSW1 to TSW6, for example, the gates of the timing adjustment switch TSW1 and the like, are connected to a timing adjustment switch control line 10*a*. The gates of the (6k−4)-th switches, for example, the gates of the timing adjustment switch TSW2 and the like, are connected to a timing adjustment switch control line 9*b*. The gates of the (6k−3)-th switches, for example, the gates of the timing adjustment switch TSW3 and the like, are connected to a timing adjustment switch control line 10*c*. The gates of the (6k−2)-th switches, for example, the gates of the timing adjustment switch TSW4 and the like, are connected to a timing adjustment switch control line 9*a*. The gates of the (6k−1)-th switches, for example, the gates of the timing adjustment switch TSW5 and the like, are connected to a timing adjustment switch control line 10*b*. The gates of the 6k-th switches, for example, the gates of the timing adjustment switch TSW6 and the like, are connected to a timing adjustment switch control line 9*c*. In addition, k is a natural number equal to or more than 1.

Figure 14:
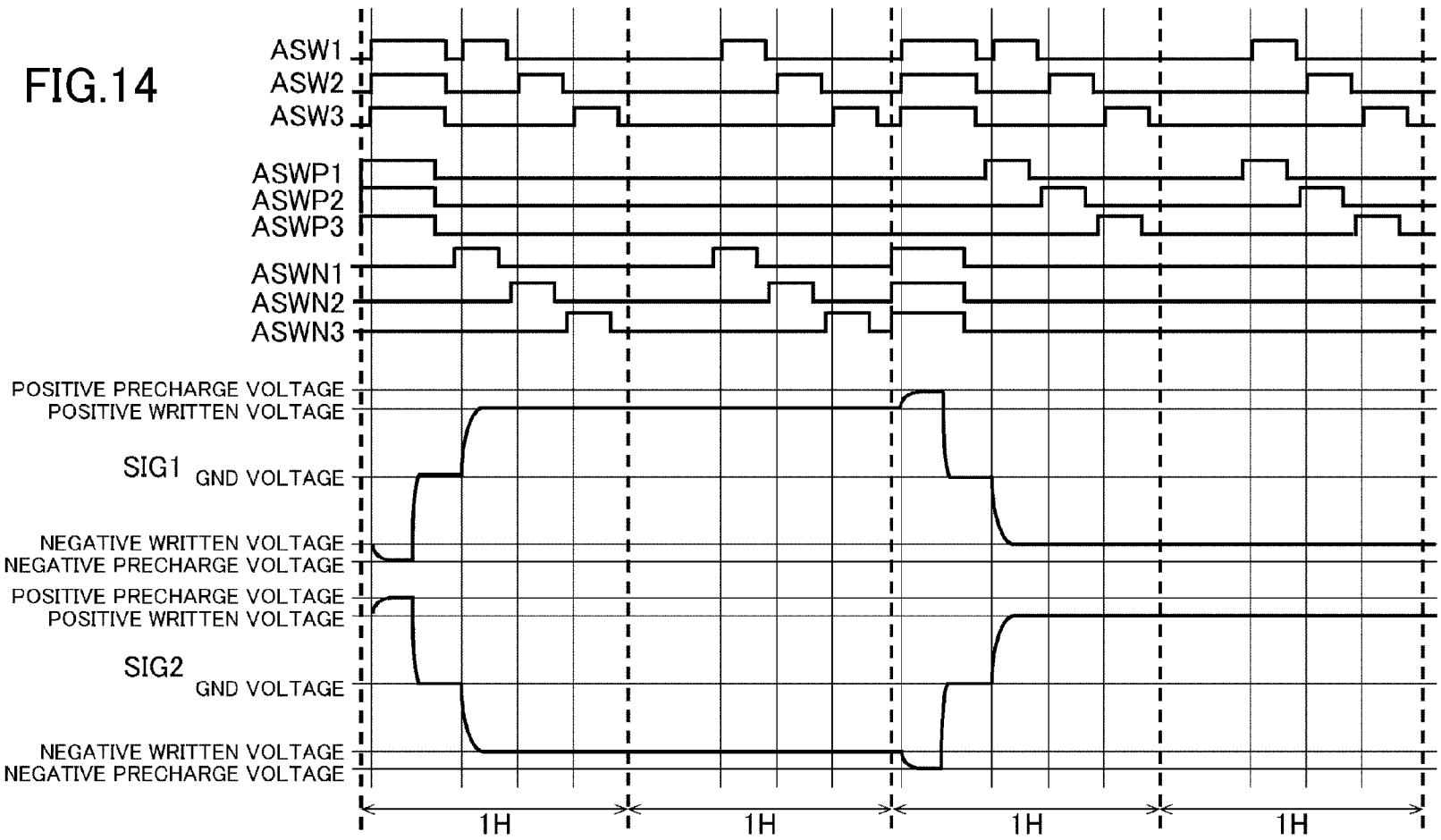
FIG. 14 is a diagram illustrating a driving timing of the data selector circuit according to the fifth embodiment.
Figure 15:
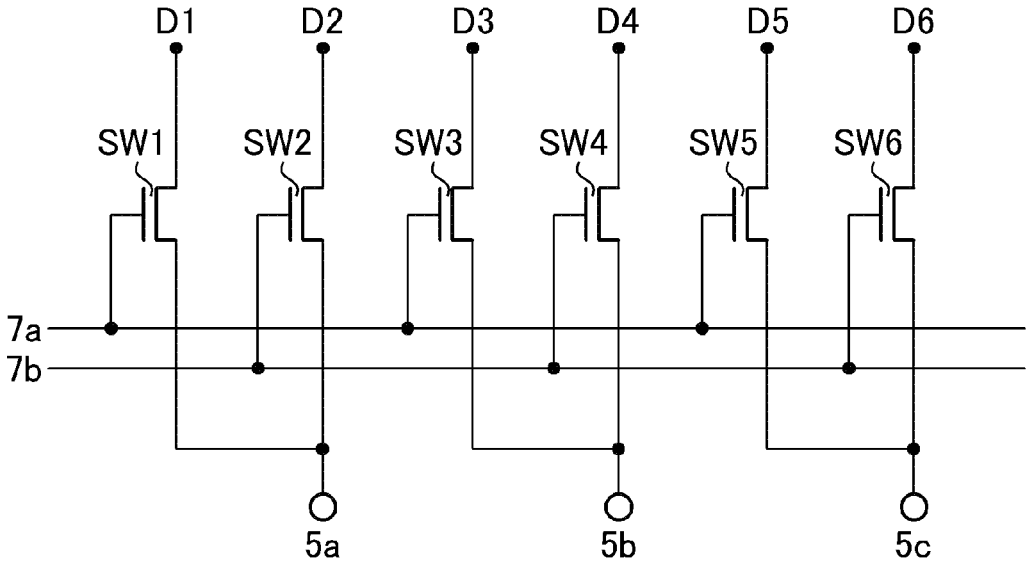
FIG. 15 is a diagram illustrating an example of the data selector circuit for explaining a problem of one or more embodiments of the present invention.

Next, a driving timing according to the present embodiment will be described. As shown in FIG. 14, after a precharge operation is performed during the initial horizontal period, writing is performed for three lines of the data lines D1 to D6, and data signals are written during the next one horizontal period. The operation is repeatedly performed while reversing polarities of precharge voltages and written voltages. In other words, the operation is the same as that in the fourth embodiment except that written voltages are output to the three lines of the data lines D1 to D6 within one horizontal period, and thus description thereof will be omitted. Similarly, a time difference due to the delay of rising of positive precharge voltages and positive written voltages is suppressed using the timing adjustment switches TSW1 to TSW6 when performing the respective precharge operations and writing operations in the data lines D1 to D6.

With the above-described configuration, when positive and negative precharge is performed, a difference as to rising of signals between the time division switches can be suppressed, and thus it is possible to suppress occurrence of noise in the display panel.

The present invention is not limited to the above-described first to fifth embodiments, and may be variously modified. For example, the present invention may be replaced with configurations which are substantially the same as the configurations indicated by the above-described first to fifth embodiments, configurations achieving the same operations and effects, or configurations capable of achieving the same object.

For example, although a so-called two-division or three-division configuration, in which an input terminal from the driver 204 is input to data lines corresponding to two or three time division switches via the two or three time division switches, has been described as an example in the first to fifth embodiments, the present invention is not limited thereto, an N-division configuration may be employed. In this case, N is a natural number equal to or more than 1.

In addition, although the one-line or two-line dot inversion configuration, in which polarities are reversed every one line or two lines has been described as an example in the first to fifth embodiments, an N-line dot inversion configuration may be employed. In this case, N is a natural number equal to or more than 1.

The data selector circuits 203 shown in the above-described first to fifth embodiments are only an example, and may be replaced with configurations which are substantially the same as the configurations of the data selector circuit 203 shown in the first to fifth embodiments, configurations achieving the same operations and effects, or configurations capable of achieving the same object. For example, although, in the above description, the time division switches SW1 to SW6 and the timing adjustment switches TSW1 to TSW6 are constituted by an NMOS transistor, they may be alternatively constituted by a PMOS transistor. In this case, since signals rising at the time division switches SW1 to SW6 becomes a reverse state, a configuration reverse to the above-described configuration may be used, that is, timings when a negative data signal or the like is applied are modified. In addition, although the predetermined period Ta is the same at the time of applying a data signal and at the time of applying a precharge voltage in the above description, different periods which are optimized for reducing noise may be used at the time of applying a positive or negative data signal and at the time of applying a positive or negative precharge voltage as long as an object which is substantially the same as the above-described object and effects can be achieved.

In addition, the display device 100 according to the present invention may be a liquid crystal display of an IPS type, a VA (Vertically Aligned) type or a TN (Twisted Nematic) type, or may be an organic EL display device, or the like.

While there have been described what are at present considered to be certain embodiments of the invention, it will be understood that various modifications may be made thereto, and it is intended that the appended claims coverall such modifications as fall within the true spirit and scope of the invention.

What is claimed is:

1. A display device comprising:

a plurality of pixels each of which has a transistor, a pixel electrode connected to the transistor, and a reference electrode disposed so as to be opposite to the pixel electrode, wherein the plurality of pixels are arranged in a matrix;

a plurality of gate lines that are respectively connected to the plurality of pixels;

a plurality of data lines that are respectively connected to the plurality of pixels;

a gate circuit that sequentially outputs gate signals to the plurality of gate lines;

a driver that includes a data circuit generating data signals, which have different polarities, according to grayscale values, for each predetermined horizontal period; and a data selector circuit that includes a plurality of switch groups each of which has a time division switch and a timing adjustment switch that are connected in parallel, wherein the data selector circuit outputs output signals from the driver, which have different polarities every one or more data lines of the plurality of data lines, to the respective data lines via the switch groups respectively connected to the data lines;

wherein each of the time division switches and the timing adjustment switches is an NMOS transistor;

wherein the driver turns on the timing adjustment switches, which are included in the switch groups connected to the data lines to which positive output signals are output from the driver, earlier than the time division switches, which are included in the switch groups connected to the data lines to which negative output signals are output from the driver, by a predetermined period, among the plurality of data lines;

wherein during a first horizontal period, the driver applies the precharge voltages having one of positive and negative polarities to the respective data lines, and applies data signals having the other polarity after applying a reference voltage, wherein during a second horizontal period after the first horizontal period, the driver applies data signals which have the same polarity as the data signals which have been applied during the first horizontal period, to the respective data lines, and wherein during the second horizontal period, the driver turns off the timing adjustment switches included in the respective switch groups.

2. A display device comprising:

a plurality of pixels each of which has a transistor, a pixel electrode connected to the transistor, and a reference electrode disposed so as to be opposite to the pixel electrode, wherein the plurality of pixels are arranged in a matrix;

a plurality of gate lines that are respectively connected to the plurality of pixels;

a plurality of data lines that are respectively connected to the plurality of pixels;

a gate circuit that sequentially outputs gate signals to the plurality of gate lines;

a driver that includes a data circuit generating data signals, which have different polarities, according to grayscale values, for each predetermined horizontal period; and a data selector circuit that includes a plurality of switch groups of which has a time division switch and a timing adjustment switch that are connected in parallel, wherein the data selector circuit outputs output signals from the driver, which have different polarities every one or more data lines of the plurality of data lines, to the respective data lines via the switch groups respectively connected to the data lines, wherein each of the time division switches and the timing adjustment switches is an NMOS transistor;

wherein the driver turns on the timing adjustment switches, which are included in the switch groups connected to the data lines to which positive output signals are output from the driver, earlier than the time division switches, which are included in the switch groups connected to the data lines to which negative output signals are output from the driver, by a predetermined period, among the plurality of data lines; and wherein the predetermined period is 0 ns to 50 ns.

3. The display device according to claim 2, wherein the output signals are data signals output from the driver.

4. The display device according to claim 2, wherein the output signals include positive and negative precharge signals, wherein the positive and negative precharge signals are output from the driver and are applied to the respective pixels before the data signals are written in the respective pixels, and wherein the positive and negative precharge signals have a voltage value larger than a voltage value of the data signals in terms of an absolute value.

5. The display device according to claim 2, wherein the data selector circuit includes a plurality of input terminals to which output signals from the driver are input, and wherein each of the input terminals is connected to two switch groups of the plurality of switch groups.

6. The display device according to claim 2, wherein the data selector circuit includes a plurality of input terminals to which output signals from the driver are input, and wherein each of the input terminals is connected to three switch groups of the plurality of switch groups.

7. The display device according to claim 2, wherein the driver outputs a reference voltage before a period for writing the data signals.

* * * * *